US011529808B2

(12) United States Patent
Kusunoki et al.

(10) Patent No.: US 11,529,808 B2
(45) Date of Patent: Dec. 20, 2022

(54) LIQUID DISCHARGE APPARATUS AND IMAGE FORMING APPARATUS

(71) Applicant: TOSHIBA TEC KABUSHIKI KAISHA, Tokyo (JP)

(72) Inventors: Ryutaro Kusunoki, Mishima Shizuoka (JP); Mengfei Wong, Mishima Shizuoka (JP); Li Xu, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/379,014

(22) Filed: Jul. 19, 2021

(65) Prior Publication Data

US 2021/0394511 A1 Dec. 23, 2021

Related U.S. Application Data

(62) Division of application No. 16/549,083, filed on Aug. 23, 2019, now Pat. No. 11,090,925.

(30) Foreign Application Priority Data

Aug. 28, 2018 (JP) ..... JP2018-159764
May 15, 2019 (JP) ..... JP2019-091896

(51) Int. Cl.
*B41J 2/045* (2006.01)

(52) U.S. Cl.
CPC ..... *B41J 2/04541* (2013.01); *B41J 2/04573* (2013.01); *B41J 2/04586* (2013.01)

(58) Field of Classification Search
CPC ..... B41J 2/04581; B41J 2/04588; B41J 2/04541; B41J 2/04573; B41J 2/04586; B41J 2/04543; B41J 2/1433; B41J 2/175
See application file for complete search history.

(56) References Cited

U.S. PATENT DOCUMENTS

2004/0017413 A1* 1/2004 Kusunoki ..... B41J 2/04581 347/11
2005/0073537 A1 4/2005 Iwao
(Continued)

FOREIGN PATENT DOCUMENTS

EP 1506862 A1 2/2005
JP 2013-091215 A 5/2013

OTHER PUBLICATIONS

Extended European Search Report dated May 29, 2020, mailed in counterpart European Patent Application No. 19193593.1, 9 pages.

*Primary Examiner* — Jannelle M Lebron
(74) *Attorney, Agent, or Firm* — Kim & Stewart LLP

(57) ABSTRACT

A liquid discharge apparatus includes a nozzle plate with nozzles and actuators and a drive controller. First and second nozzles are directly adjacent to each other in a first direction. First and third nozzles are directly adjacent to each other in a second direction. The drive controller is configured to apply a drive signal to first, second, and third actuators corresponding to the first, second, and third nozzles, respectively, during a drive cycle. A difference between a first timing at which the drive signal is applied to the first actuator and a second timing at which the drive signal is applied to the second actuator and a difference between the first timing and a third timing at which the drive signal is applied to the third actuator is an odd number multiple of a half of an inherent vibration cycle of the liquid discharge apparatus.

10 Claims, 22 Drawing Sheets

(56) References Cited

U.S. PATENT DOCUMENTS

| | | | | |
|---|---|---|---|---|
| 2007/0140917 | A1* | 6/2007 | Yamashita | B41J 2/04588<br>422/400 |
| 2012/0281047 | A1 | 11/2012 | Barbet | |
| 2016/0075132 | A1 | 3/2016 | Kitaoka et al. | |

* cited by examiner

*FIG. 11*

| | (8n-7)TH ROW | | | | | | | (8n)TH ROW |
|---|---|---|---|---|---|---|---|---|
| FIRST COLUMN | 0 | 1 | 2 | 1 | 0 | 1 | 2 | 1 |
| | 1 | 2 | 3 | 2 | 1 | 2 | 3 | 2 |
| | 2 | 3 | 4 | 3 | 2 | 3 | 4 | 3 |
| | 3 | 4 | 5 | 4 | 3 | 4 | 5 | 4 |
| | 4 | 5 | 6 | 5 | 4 | 5 | 6 | 5 |
| | 3 | 4 | 5 | 4 | 3 | 4 | 5 | 4 |
| | 2 | 3 | 4 | 3 | 2 | 3 | 4 | 3 |
| EIGHTH COLUMN | 1 | 2 | 3 | 2 | 1 | 2 | 3 | 2 |

DELAY TIME (AL UNIT)

FIG. 12

FIRST EMBODIMENT

| | (8n-7)TH ROW | | | | | | | (8n)TH ROW |
|---|---|---|---|---|---|---|---|---|
| FIRST COLUMN | 0 | 1 | 2 | 1 | 0 | 1 | 2 | 1 |
| | 1 | 2 | 3 | 2 | 1 | 2 | 3 | 2 |
| | 2 | 3 | 4 | 3 | 2 | 3 | 4 | 3 |
| | 3 | 4 | 5 | 4 | 3 | 4 | 5 | 4 |
| | 4 | 5 | 6 | 5 | 4 | 5 | 6 | 5 |
| | 3 | 4 | 5 | 4 | 3 | 4 | 5 | 4 |
| | 2 | 3 | 4 | 3 | 2 | 3 | 4 | 3 |
| EIGHTH COLUMN | 1 | 2 | 3 | 2 | 1 | 2 | 3 | 2 |

SECOND EMBODIMENT

| | (8n-7)TH ROW | | | | | | | (8n)TH ROW |
|---|---|---|---|---|---|---|---|---|
| FIRST COLUMN | 0 | 1 | 2 | 1 | 0 | 1 | 2 | 1 |
| | 1 | 2 | 3 | 2 | 1 | 2 | 3 | 2 |
| | 2 | 3 | 4 | 3 | 2 | 3 | 4 | 3 |
| | 3 | 4 | 5 | 4 | 3 | 4 | 5 | 4 |
| | 4 | 5 | 6 | 5 | 4 | 5 | 6 | 5 |
| | 5 | 6 | 7 | 6 | 5 | 6 | 7 | 6 |
| | 6 | 7 | 8 | 7 | 6 | 7 | 8 | 7 |
| EIGHTH COLUMN | 7 | 8 | 9 | 8 | 7 | 8 | 9 | 8 |

THIRD EMBODIMENT

| | (8n-7)TH ROW | | | | | | | (8n)TH ROW |
|---|---|---|---|---|---|---|---|---|
| FIRST COLUMN | 0 | 1 | 2 | 1 | 0 | 1 | 2 | 1 |
| | 1 | 2 | 3 | 2 | 1 | 2 | 3 | 2 |
| | 0 | 1 | 2 | 1 | 0 | 1 | 2 | 1 |
| | 1 | 2 | 3 | 2 | 1 | 2 | 3 | 2 |
| | 0 | 1 | 2 | 1 | 0 | 1 | 2 | 1 |
| | 1 | 2 | 3 | 2 | 1 | 2 | 3 | 2 |
| | 0 | 1 | 2 | 1 | 0 | 1 | 2 | 1 |
| EIGHTH COLUMN | 1 | 2 | 3 | 2 | 1 | 2 | 3 | 2 |

FOURTH EMBODIMENT

| | (8n-7)TH ROW | | | | | | | (8n)TH ROW |
|---|---|---|---|---|---|---|---|---|
| FIRST COLUMN | 0 | 1 | 2 | 1 | 0 | 1 | 2 | 1 |
| | 1 | 2 | 1 | 0 | 1 | 2 | 1 | 0 |
| | 2 | 1 | 0 | 1 | 2 | 1 | 0 | 1 |
| | 1 | 0 | 1 | 2 | 1 | 0 | 1 | 2 |
| | 0 | 1 | 2 | 1 | 0 | 1 | 2 | 1 |
| | 1 | 2 | 1 | 0 | 1 | 2 | 1 | 0 |
| | 2 | 1 | 0 | 1 | 2 | 1 | 0 | 1 |
| EIGHTH COLUMN | 1 | 0 | 1 | 2 | 1 | 0 | 1 | 2 |

FIFTH EMBODIMENT

| | (8n-7)TH ROW | | | | | | | (8n)TH ROW |
|---|---|---|---|---|---|---|---|---|
| FIRST COLUMN | 0 | 1 | 2 | 3 | 0 | 1 | 2 | 3 |
| | 1 | 2 | 3 | 4 | 1 | 2 | 3 | 4 |
| | 2 | 3 | 4 | 5 | 2 | 3 | 4 | 5 |
| | 3 | 4 | 5 | 6 | 3 | 4 | 5 | 6 |
| | 4 | 5 | 6 | 7 | 4 | 5 | 6 | 7 |
| | 3 | 4 | 5 | 6 | 3 | 4 | 5 | 6 |
| | 2 | 3 | 4 | 5 | 2 | 3 | 4 | 5 |
| EIGHTH COLUMN | 1 | 2 | 3 | 4 | 1 | 2 | 3 | 4 |

SIXTH EMBODIMENT

| | (8n-7)TH ROW | | | | | | | (8n)TH ROW |
|---|---|---|---|---|---|---|---|---|
| FIRST COLUMN | 0 | 1 | 2 | 3 | 0 | 1 | 2 | 3 |
| | 1 | 2 | 3 | 4 | 1 | 2 | 3 | 4 |
| | 2 | 3 | 4 | 5 | 2 | 3 | 4 | 5 |
| | 3 | 4 | 5 | 6 | 3 | 4 | 5 | 6 |
| | 4 | 5 | 6 | 7 | 4 | 5 | 6 | 7 |
| | 5 | 6 | 7 | 8 | 5 | 6 | 7 | 8 |
| | 6 | 7 | 8 | 9 | 6 | 7 | 8 | 9 |
| EIGHTH COLUMN | 7 | 8 | 9 | 10 | 7 | 8 | 9 | 10 |

SEVENTH EMBODIMENT

| | (8n-7)TH ROW | | | | | | | (8n)TH ROW |
|---|---|---|---|---|---|---|---|---|
| FIRST COLUMN | 0 | 1 | 2 | 3 | 0 | 1 | 2 | 3 |
| | 1 | 2 | 3 | 4 | 1 | 2 | 3 | 4 |
| | 0 | 1 | 2 | 3 | 0 | 1 | 2 | 3 |
| | 1 | 2 | 3 | 4 | 1 | 2 | 3 | 4 |
| | 0 | 1 | 2 | 3 | 0 | 1 | 2 | 3 |
| | 1 | 2 | 3 | 4 | 1 | 2 | 3 | 4 |
| | 0 | 1 | 2 | 3 | 0 | 1 | 2 | 3 |
| EIGHTH COLUMN | 1 | 2 | 3 | 4 | 1 | 2 | 3 | 4 |

EIGHTH EMBODIMENT

| | (8n-7)TH ROW | | | | | | | (8n)TH ROW |
|---|---|---|---|---|---|---|---|---|
| FIRST COLUMN | 0 | 1 | 2 | 3 | 0 | 1 | 2 | 3 |
| | 1 | 2 | 3 | 0 | 1 | 2 | 3 | 0 |
| | 2 | 3 | 0 | 1 | 2 | 3 | 0 | 1 |
| | 3 | 0 | 1 | 2 | 3 | 0 | 1 | 2 |
| | 0 | 1 | 2 | 3 | 0 | 1 | 2 | 3 |
| | 1 | 2 | 3 | 0 | 1 | 2 | 3 | 0 |
| | 2 | 3 | 0 | 1 | 2 | 3 | 0 | 1 |
| EIGHTH COLUMN | 3 | 0 | 1 | 2 | 3 | 0 | 1 | 2 |

NINTH EMBODIMENT

| | (8n-7)TH ROW | | | | | | | (8n)TH ROW |
|---|---|---|---|---|---|---|---|---|
| FIRST COLUMN | 0 | 1 | 0 | 1 | 0 | 1 | 0 | 1 |
| | 1 | 2 | 1 | 2 | 1 | 2 | 1 | 2 |
| | 2 | 3 | 2 | 3 | 2 | 3 | 2 | 3 |
| | 3 | 4 | 3 | 4 | 3 | 4 | 3 | 4 |
| | 4 | 5 | 4 | 5 | 4 | 5 | 4 | 5 |
| | 3 | 4 | 3 | 4 | 3 | 4 | 3 | 4 |
| | 2 | 3 | 2 | 3 | 2 | 3 | 2 | 3 |
| EIGHTH COLUMN | 1 | 2 | 1 | 2 | 1 | 2 | 1 | 2 |

TENTH EMBODIMENT

| | (8n-7)TH ROW | | | | | | | (8n)TH ROW |
|---|---|---|---|---|---|---|---|---|
| FIRST COLUMN | 0 | 1 | 0 | 1 | 0 | 1 | 0 | 1 |
| | 1 | 2 | 1 | 2 | 1 | 2 | 1 | 2 |
| | 2 | 3 | 2 | 3 | 2 | 3 | 2 | 3 |
| | 3 | 4 | 3 | 4 | 3 | 4 | 3 | 4 |
| | 4 | 5 | 4 | 5 | 4 | 5 | 4 | 5 |
| | 5 | 6 | 5 | 6 | 5 | 6 | 5 | 6 |
| | 6 | 7 | 6 | 7 | 6 | 7 | 6 | 7 |
| EIGHTH COLUMN | 7 | 8 | 7 | 8 | 7 | 8 | 7 | 8 |

ELEVENTH EMBODIMENT

| | (8n-7)TH ROW | | | | | | | (8n)TH ROW |
|---|---|---|---|---|---|---|---|---|
| FIRST COLUMN | 0 | 1 | 0 | 1 | 0 | 1 | 0 | 1 |
| | 1 | 2 | 1 | 2 | 1 | 2 | 1 | 2 |
| | 0 | 1 | 0 | 1 | 0 | 1 | 0 | 1 |
| | 1 | 2 | 1 | 2 | 1 | 2 | 1 | 2 |
| | 0 | 1 | 0 | 1 | 0 | 1 | 0 | 1 |
| | 1 | 2 | 1 | 2 | 1 | 2 | 1 | 2 |
| | 0 | 1 | 0 | 1 | 0 | 1 | 0 | 1 |
| EIGHTH COLUMN | 1 | 2 | 1 | 2 | 1 | 2 | 1 | 2 |

TWELFTH EMBODIMENT

| | (8n-7)TH ROW | | | | | | | (8n)TH ROW |
|---|---|---|---|---|---|---|---|---|
| FIRST COLUMN | 0 | 1 | 0 | 1 | 0 | 1 | 0 | 1 |
| | 1 | 0 | 1 | 0 | 1 | 0 | 1 | 0 |
| | 0 | 1 | 0 | 1 | 0 | 1 | 0 | 1 |
| | 1 | 0 | 1 | 0 | 1 | 0 | 1 | 0 |
| | 0 | 1 | 0 | 1 | 0 | 1 | 0 | 1 |
| | 1 | 0 | 1 | 0 | 1 | 0 | 1 | 0 |
| | 0 | 1 | 0 | 1 | 0 | 1 | 0 | 1 |
| EIGHTH COLUMN | 1 | 0 | 1 | 0 | 1 | 0 | 1 | 0 |

FIG. 13

THIRTEENTH EMBODIMENT

CYCLE 1

| | (8n-7)TH ROW | | | | (8n)TH ROW |
|---|---|---|---|---|---|
| FIRST COLUMN | 0 | 1 | 0 | 1 | |
| | 1 | 2 | 1 | 2 | |
| | 2 | 3 | 2 | 3 | |
| | 3 | 4 | 3 | 4 | |
| | 4 | 5 | 4 | 5 | |
| | 3 | 4 | 3 | 4 | |
| | 2 | 3 | 2 | 3 | |
| EIGHTH COLUMN | 1 | 2 | 1 | 2 | |

CYCLE 2

| | (8n-7)TH ROW | | | | (8n)TH ROW |
|---|---|---|---|---|---|
| FIRST COLUMN | | 0 | 1 | 0 | 1 |
| | | 1 | 2 | 1 | 2 |
| | | 2 | 3 | 2 | 3 |
| | | 3 | 4 | 3 | 4 |
| | | 4 | 5 | 4 | 5 |
| | | 3 | 4 | 3 | 4 |
| | | 2 | 3 | 2 | 3 |
| EIGHTH COLUMN | | 1 | 2 | 1 | 2 |

FOURTEENTH EMBODIMENT

CYCLE 1

| | (8n-7)TH ROW | | | | (8n)TH ROW |
|---|---|---|---|---|---|
| FIRST COLUMN | 0 | 1 | 0 | 1 | |
| | 1 | 2 | 1 | 2 | |
| | 2 | 3 | 2 | 3 | |
| | 3 | 4 | 3 | 4 | |
| | 4 | 5 | 4 | 5 | |
| | 5 | 6 | 5 | 6 | |
| | 6 | 7 | 6 | 7 | |
| EIGHTH COLUMN | 7 | 8 | 7 | 8 | |

CYCLE 2

| | (8n-7)TH ROW | | | | (8n)TH ROW |
|---|---|---|---|---|---|
| FIRST COLUMN | | 0 | 1 | 0 | 1 |
| | | 1 | 2 | 1 | 2 |
| | | 2 | 3 | 2 | 3 |
| | | 3 | 4 | 3 | 4 |
| | | 4 | 5 | 4 | 5 |
| | | 5 | 6 | 5 | 6 |
| | | 6 | 7 | 6 | 7 |
| EIGHTH COLUMN | | 7 | 8 | 7 | 8 |

FIFTEENTH EMBODIMENT

CYCLE 1

| | (8n-7)TH ROW | | | | (6n)TH ROW |
|---|---|---|---|---|---|
| FIRST COLUMN | 0 | 1 | 0 | 1 | |
| | 1 | 2 | 1 | 2 | |
| | 0 | 1 | 0 | 1 | |
| | 1 | 2 | 1 | 2 | |
| | 0 | 1 | 0 | 1 | |
| | 1 | 2 | 1 | 2 | |
| | 0 | 1 | 0 | 1 | |
| EIGHTH COLUMN | 1 | 2 | 1 | 2 | |

CYCLE 2

| | (8n-7)TH ROW | | | | (8n)TH ROW |
|---|---|---|---|---|---|
| FIRST COLUMN | | 0 | 1 | 0 | 1 |
| | | 1 | 2 | 1 | 2 |
| | | 0 | 1 | 0 | 1 |
| | | 1 | 2 | 1 | 2 |
| | | 0 | 1 | 0 | 1 |
| | | 1 | 2 | 1 | 2 |
| | | 0 | 1 | 0 | 1 |
| EIGHTH COLUMN | | 1 | 2 | 1 | 2 |

SIXTEENTH EMBODIMENT

CYCLE 1

| | (8n-7)TH ROW | | | | (8n)TH ROW |
|---|---|---|---|---|---|
| FIRST COLUMN | 0 | 1 | 0 | 1 | |
| | | 1 | 0 | 1 | 0 |
| | 1 | 0 | 1 | 0 | |
| | | 0 | 1 | 0 | 1 |
| | 0 | 1 | 0 | 1 | |
| | | 1 | 0 | 1 | 0 |
| | 1 | 0 | 1 | 0 | |
| EIGHTH COLUMN | | 0 | 1 | 0 | 1 |

CYCLE 2

| | (8n-7)TH ROW | | | | (8n)TH ROW |
|---|---|---|---|---|---|
| FIRST COLUMN | | 0 | 1 | 0 | 1 |
| | 0 | 1 | 0 | 1 | |
| | | 1 | 0 | 1 | 0 |
| | 1 | 0 | 1 | 0 | |
| | | 0 | 1 | 0 | 1 |
| | 0 | 1 | 0 | 1 | |
| | | 1 | 0 | 1 | 0 |
| EIGHTH COLUMN | 1 | 0 | 1 | 0 | |

FIG. 14

DRIVE PATTERN 1

| | | | | | | | |
|---|---|---|---|---|---|---|---|
| 1 | 1 | 1 | 1 | 1 | 1 | 1 | 1 |
| 1 | 1 | 1 | 1 | 1 | 1 | 1 | 1 |
| 1 | 1 | 1 | 1 | 1 | 1 | 1 | 1 |
| 1 | 1 | 1 | 1 | 1 | 1 | 1 | 1 |
| 1 | 1 | 1 | 1 | 1 | 1 | 1 | 1 |
| 1 | 1 | 1 | 1 | 1 | 1 | 1 | 1 |
| 1 | 1 | 1 | 1 | 1 | 1 | 1 | 1 |
| 1 | 1 | 1 | 1 | 1 | 1 | 1 | 1 |

DRIVE PATTERN 2

| | | | | | | | |
|---|---|---|---|---|---|---|---|
| 1 | 1 | 1 | 1 | 1 | 1 | 1 | 1 |
| 0 | 0 | 0 | 0 | 0 | 0 | 0 | 0 |
| 1 | 1 | 1 | 1 | 1 | 1 | 1 | 1 |
| 0 | 0 | 0 | 0 | 0 | 0 | 0 | 0 |
| 1 | 1 | 1 | 1 | 1 | 1 | 1 | 1 |
| 0 | 0 | 0 | 0 | 0 | 0 | 0 | 0 |
| 1 | 1 | 1 | 1 | 1 | 1 | 1 | 1 |
| 0 | 0 | 0 | 0 | 0 | 0 | 0 | 0 |

DRIVE PATTERN 3

| | | | | | | | |
|---|---|---|---|---|---|---|---|
| 0 | 0 | 0 | 0 | 0 | 0 | 0 | 0 |
| 1 | 1 | 1 | 1 | 1 | 1 | 1 | 1 |
| 0 | 0 | 0 | 0 | 0 | 0 | 0 | 0 |
| 1 | 1 | 1 | 1 | 1 | 1 | 1 | 1 |
| 0 | 0 | 0 | 0 | 0 | 0 | 0 | 0 |
| 1 | 1 | 1 | 1 | 1 | 1 | 1 | 1 |
| 0 | 0 | 0 | 0 | 0 | 0 | 0 | 0 |
| 1 | 1 | 1 | 1 | 1 | 1 | 1 | 1 |

0: NON-DISCHARGE

1: DISCHARGE

DRIVE PATTERN 4

| | | | | | | | |
|---|---|---|---|---|---|---|---|
| 1 | 1 | 1 | 1 | 1 | 1 | 1 | 1 |
| 1 | 1 | 1 | 1 | 1 | 1 | 1 | 1 |
| 0 | 0 | 0 | 0 | 0 | 0 | 0 | 0 |
| 0 | 0 | 0 | 0 | 0 | 0 | 0 | 0 |
| 1 | 1 | 1 | 1 | 1 | 1 | 1 | 1 |
| 1 | 1 | 1 | 1 | 1 | 1 | 1 | 1 |
| 0 | 0 | 0 | 0 | 0 | 0 | 0 | 0 |
| 0 | 0 | 0 | 0 | 0 | 0 | 0 | 0 |

DRIVE PATTERN 5

| | | | | | | | |
|---|---|---|---|---|---|---|---|
| 0 | 0 | 0 | 0 | 0 | 0 | 0 | 0 |
| 1 | 1 | 1 | 1 | 1 | 1 | 1 | 1 |
| 1 | 1 | 1 | 1 | 1 | 1 | 1 | 1 |
| 0 | 0 | 0 | 0 | 0 | 0 | 0 | 0 |
| 0 | 0 | 0 | 0 | 0 | 0 | 0 | 0 |
| 1 | 1 | 1 | 1 | 1 | 1 | 1 | 1 |
| 1 | 1 | 1 | 1 | 1 | 1 | 1 | 1 |
| 0 | 0 | 0 | 0 | 0 | 0 | 0 | 0 |

DRIVE PATTERN 6

| | | | | | | | |
|---|---|---|---|---|---|---|---|
| 0 | 0 | 0 | 0 | 0 | 0 | 0 | 0 |
| 0 | 0 | 0 | 0 | 0 | 0 | 0 | 0 |
| 1 | 1 | 1 | 1 | 1 | 1 | 1 | 1 |
| 1 | 1 | 1 | 1 | 1 | 1 | 1 | 1 |
| 0 | 0 | 0 | 0 | 0 | 0 | 0 | 0 |
| 0 | 0 | 0 | 0 | 0 | 0 | 0 | 0 |
| 1 | 1 | 1 | 1 | 1 | 1 | 1 | 1 |
| 1 | 1 | 1 | 1 | 1 | 1 | 1 | 1 |

DRIVE PATTERN 7

| | | | | | | | |
|---|---|---|---|---|---|---|---|
| 1 | 1 | 1 | 1 | 1 | 1 | 1 | 1 |
| 0 | 0 | 0 | 0 | 0 | 0 | 0 | 0 |
| 0 | 0 | 0 | 0 | 0 | 0 | 0 | 0 |
| 1 | 1 | 1 | 1 | 1 | 1 | 1 | 1 |
| 1 | 1 | 1 | 1 | 1 | 1 | 1 | 1 |
| 0 | 0 | 0 | 0 | 0 | 0 | 0 | 0 |
| 0 | 0 | 0 | 0 | 0 | 0 | 0 | 0 |
| 1 | 1 | 1 | 1 | 1 | 1 | 1 | 1 |

DRIVE PATTERN 8

| | | | | | | | |
|---|---|---|---|---|---|---|---|
| 1 | 1 | 1 | 1 | 1 | 1 | 1 | 1 |
| 1 | 1 | 1 | 1 | 1 | 1 | 1 | 1 |
| 1 | 1 | 1 | 1 | 1 | 1 | 1 | 1 |
| 1 | 1 | 1 | 1 | 1 | 1 | 1 | 1 |
| 0 | 0 | 0 | 0 | 0 | 0 | 0 | 0 |
| 0 | 0 | 0 | 0 | 0 | 0 | 0 | 0 |
| 0 | 0 | 0 | 0 | 0 | 0 | 0 | 0 |
| 0 | 0 | 0 | 0 | 0 | 0 | 0 | 0 |

DRIVE PATTERN 9

| | | | | | | | |
|---|---|---|---|---|---|---|---|
| 0 | 0 | 0 | 0 | 0 | 0 | 0 | 0 |
| 1 | 1 | 1 | 1 | 1 | 1 | 1 | 1 |
| 1 | 1 | 1 | 1 | 1 | 1 | 1 | 1 |
| 1 | 1 | 1 | 1 | 1 | 1 | 1 | 1 |
| 1 | 1 | 1 | 1 | 1 | 1 | 1 | 1 |
| 0 | 0 | 0 | 0 | 0 | 0 | 0 | 0 |
| 0 | 0 | 0 | 0 | 0 | 0 | 0 | 0 |
| 0 | 0 | 0 | 0 | 0 | 0 | 0 | 0 |

DRIVE PATTERN 10

| | | | | | | | |
|---|---|---|---|---|---|---|---|
| 0 | 0 | 0 | 0 | 0 | 0 | 0 | 0 |
| 0 | 0 | 0 | 0 | 0 | 0 | 0 | 0 |
| 1 | 1 | 1 | 1 | 1 | 1 | 1 | 1 |
| 1 | 1 | 1 | 1 | 1 | 1 | 1 | 1 |
| 1 | 1 | 1 | 1 | 1 | 1 | 1 | 1 |
| 1 | 1 | 1 | 1 | 1 | 1 | 1 | 1 |
| 0 | 0 | 0 | 0 | 0 | 0 | 0 | 0 |
| 0 | 0 | 0 | 0 | 0 | 0 | 0 | 0 |

DRIVE PATTERN 11

| | | | | | | | |
|---|---|---|---|---|---|---|---|
| 0 | 0 | 0 | 0 | 0 | 0 | 0 | 0 |
| 0 | 0 | 0 | 0 | 0 | 0 | 0 | 0 |
| 0 | 0 | 0 | 0 | 0 | 0 | 0 | 0 |
| 1 | 1 | 1 | 1 | 1 | 1 | 1 | 1 |
| 1 | 1 | 1 | 1 | 1 | 1 | 1 | 1 |
| 1 | 1 | 1 | 1 | 1 | 1 | 1 | 1 |
| 1 | 1 | 1 | 1 | 1 | 1 | 1 | 1 |
| 0 | 0 | 0 | 0 | 0 | 0 | 0 | 0 |

DRIVE PATTERN 12

| | | | | | | | |
|---|---|---|---|---|---|---|---|
| 0 | 0 | 0 | 0 | 0 | 0 | 0 | 0 |
| 0 | 0 | 0 | 0 | 0 | 0 | 0 | 0 |
| 0 | 0 | 0 | 0 | 0 | 0 | 0 | 0 |
| 0 | 0 | 0 | 0 | 0 | 0 | 0 | 0 |
| 1 | 1 | 1 | 1 | 1 | 1 | 1 | 1 |
| 1 | 1 | 1 | 1 | 1 | 1 | 1 | 1 |
| 1 | 1 | 1 | 1 | 1 | 1 | 1 | 1 |
| 1 | 1 | 1 | 1 | 1 | 1 | 1 | 1 |

DRIVE PATTERN 13

| | | | | | | | |
|---|---|---|---|---|---|---|---|
| 1 | 1 | 1 | 1 | 1 | 1 | 1 | 1 |
| 0 | 0 | 0 | 0 | 0 | 0 | 0 | 0 |
| 0 | 0 | 0 | 0 | 0 | 0 | 0 | 0 |
| 0 | 0 | 0 | 0 | 0 | 0 | 0 | 0 |
| 0 | 0 | 0 | 0 | 0 | 0 | 0 | 0 |
| 1 | 1 | 1 | 1 | 1 | 1 | 1 | 1 |
| 1 | 1 | 1 | 1 | 1 | 1 | 1 | 1 |
| 1 | 1 | 1 | 1 | 1 | 1 | 1 | 1 |

DRIVE PATTERN 14

| | | | | | | | |
|---|---|---|---|---|---|---|---|
| 1 | 1 | 1 | 1 | 1 | 1 | 1 | 1 |
| 1 | 1 | 1 | 1 | 1 | 1 | 1 | 1 |
| 0 | 0 | 0 | 0 | 0 | 0 | 0 | 0 |
| 0 | 0 | 0 | 0 | 0 | 0 | 0 | 0 |
| 0 | 0 | 0 | 0 | 0 | 0 | 0 | 0 |
| 0 | 0 | 0 | 0 | 0 | 0 | 0 | 0 |
| 1 | 1 | 1 | 1 | 1 | 1 | 1 | 1 |
| 1 | 1 | 1 | 1 | 1 | 1 | 1 | 1 |

DRIVE PATTERN 15

| | | | | | | | |
|---|---|---|---|---|---|---|---|
| 1 | 1 | 1 | 1 | 1 | 1 | 1 | 1 |
| 1 | 1 | 1 | 1 | 1 | 1 | 1 | 1 |
| 1 | 1 | 1 | 1 | 1 | 1 | 1 | 1 |
| 0 | 0 | 0 | 0 | 0 | 0 | 0 | 0 |
| 0 | 0 | 0 | 0 | 0 | 0 | 0 | 0 |
| 0 | 0 | 0 | 0 | 0 | 0 | 0 | 0 |
| 0 | 0 | 0 | 0 | 0 | 0 | 0 | 0 |
| 1 | 1 | 1 | 1 | 1 | 1 | 1 | 1 |

FIG. 15

0: NON-DISCHARGE

1: DISCHARGE

DRIVE PATTERN 16

| | | | | | | | |
|---|---|---|---|---|---|---|---|
| 1 | 0 | 1 | 0 | 1 | 0 | 1 | 0 |
| 1 | 0 | 1 | 0 | 1 | 0 | 1 | 0 |
| 1 | 0 | 1 | 0 | 1 | 0 | 1 | 0 |
| 1 | 0 | 1 | 0 | 1 | 0 | 1 | 0 |
| 1 | 0 | 1 | 0 | 1 | 0 | 1 | 0 |
| 1 | 0 | 1 | 0 | 1 | 0 | 1 | 0 |
| 1 | 0 | 1 | 0 | 1 | 0 | 1 | 0 |
| 1 | 0 | 1 | 0 | 1 | 0 | 1 | 0 |

DRIVE PATTERN 17

| | | | | | | | |
|---|---|---|---|---|---|---|---|
| 0 | 1 | 0 | 1 | 0 | 1 | 0 | 1 |
| 0 | 1 | 0 | 1 | 0 | 1 | 0 | 1 |
| 0 | 1 | 0 | 1 | 0 | 1 | 0 | 1 |
| 0 | 1 | 0 | 1 | 0 | 1 | 0 | 1 |
| 0 | 1 | 0 | 1 | 0 | 1 | 0 | 1 |
| 0 | 1 | 0 | 1 | 0 | 1 | 0 | 1 |
| 0 | 1 | 0 | 1 | 0 | 1 | 0 | 1 |
| 0 | 1 | 0 | 1 | 0 | 1 | 0 | 1 |

DRIVE PATTERN 18

| | | | | | | | |
|---|---|---|---|---|---|---|---|
| 1 | 1 | 0 | 0 | 1 | 1 | 0 | 0 |
| 1 | 1 | 0 | 0 | 1 | 1 | 0 | 0 |
| 1 | 1 | 0 | 0 | 1 | 1 | 0 | 0 |
| 1 | 1 | 0 | 0 | 1 | 1 | 0 | 0 |
| 1 | 1 | 0 | 0 | 1 | 1 | 0 | 0 |
| 1 | 1 | 0 | 0 | 1 | 1 | 0 | 0 |
| 1 | 1 | 0 | 0 | 1 | 1 | 0 | 0 |
| 1 | 1 | 0 | 0 | 1 | 1 | 0 | 0 |

DRIVE PATTERN 19

| | | | | | | | |
|---|---|---|---|---|---|---|---|
| 0 | 1 | 1 | 0 | 0 | 1 | 1 | 0 |
| 0 | 1 | 1 | 0 | 0 | 1 | 1 | 0 |
| 0 | 1 | 1 | 0 | 0 | 1 | 1 | 0 |
| 0 | 1 | 1 | 0 | 0 | 1 | 1 | 0 |
| 0 | 1 | 1 | 0 | 0 | 1 | 1 | 0 |
| 0 | 1 | 1 | 0 | 0 | 1 | 1 | 0 |
| 0 | 1 | 1 | 0 | 0 | 1 | 1 | 0 |
| 0 | 1 | 1 | 0 | 0 | 1 | 1 | 0 |

DRIVE PATTERN 20

| | | | | | | | |
|---|---|---|---|---|---|---|---|
| 0 | 0 | 1 | 1 | 0 | 0 | 1 | 1 |
| 0 | 0 | 1 | 1 | 0 | 0 | 1 | 1 |
| 0 | 0 | 1 | 1 | 0 | 0 | 1 | 1 |
| 0 | 0 | 1 | 1 | 0 | 0 | 1 | 1 |
| 0 | 0 | 1 | 1 | 0 | 0 | 1 | 1 |
| 0 | 0 | 1 | 1 | 0 | 0 | 1 | 1 |
| 0 | 0 | 1 | 1 | 0 | 0 | 1 | 1 |
| 0 | 0 | 1 | 1 | 0 | 0 | 1 | 1 |

DRIVE PATTERN 21

| | | | | | | | |
|---|---|---|---|---|---|---|---|
| 1 | 0 | 0 | 1 | 1 | 0 | 0 | 1 |
| 1 | 0 | 0 | 1 | 1 | 0 | 0 | 1 |
| 1 | 0 | 0 | 1 | 1 | 0 | 0 | 1 |
| 1 | 0 | 0 | 1 | 1 | 0 | 0 | 1 |
| 1 | 0 | 0 | 1 | 1 | 0 | 0 | 1 |
| 1 | 0 | 0 | 1 | 1 | 0 | 0 | 1 |
| 1 | 0 | 0 | 1 | 1 | 0 | 0 | 1 |
| 1 | 0 | 0 | 1 | 1 | 0 | 0 | 1 |

DRIVE PATTERN 22

| | | | | | | | |
|---|---|---|---|---|---|---|---|
| 1 | 1 | 1 | 1 | 0 | 0 | 0 | 0 |
| 1 | 1 | 1 | 1 | 0 | 0 | 0 | 0 |
| 1 | 1 | 1 | 1 | 0 | 0 | 0 | 0 |
| 1 | 1 | 1 | 1 | 0 | 0 | 0 | 0 |
| 1 | 1 | 1 | 1 | 0 | 0 | 0 | 0 |
| 1 | 1 | 1 | 1 | 0 | 0 | 0 | 0 |
| 1 | 1 | 1 | 1 | 0 | 0 | 0 | 0 |
| 1 | 1 | 1 | 1 | 0 | 0 | 0 | 0 |

DRIVE PATTERN 23

| | | | | | | | |
|---|---|---|---|---|---|---|---|
| 0 | 1 | 1 | 1 | 1 | 0 | 0 | 0 |
| 0 | 1 | 1 | 1 | 1 | 0 | 0 | 0 |
| 0 | 1 | 1 | 1 | 1 | 0 | 0 | 0 |
| 0 | 1 | 1 | 1 | 1 | 0 | 0 | 0 |
| 0 | 1 | 1 | 1 | 1 | 0 | 0 | 0 |
| 0 | 1 | 1 | 1 | 1 | 0 | 0 | 0 |
| 0 | 1 | 1 | 1 | 1 | 0 | 0 | 0 |
| 0 | 1 | 1 | 1 | 1 | 0 | 0 | 0 |

DRIVE PATTERN 24

| | | | | | | | |
|---|---|---|---|---|---|---|---|
| 0 | 0 | 1 | 1 | 1 | 1 | 0 | 0 |
| 0 | 0 | 1 | 1 | 1 | 1 | 0 | 0 |
| 0 | 0 | 1 | 1 | 1 | 1 | 0 | 0 |
| 0 | 0 | 1 | 1 | 1 | 1 | 0 | 0 |
| 0 | 0 | 1 | 1 | 1 | 1 | 0 | 0 |
| 0 | 0 | 1 | 1 | 1 | 1 | 0 | 0 |
| 0 | 0 | 1 | 1 | 1 | 1 | 0 | 0 |
| 0 | 0 | 1 | 1 | 1 | 1 | 0 | 0 |

DRIVE PATTERN 25

| | | | | | | | |
|---|---|---|---|---|---|---|---|
| 0 | 0 | 0 | 1 | 1 | 1 | 1 | 0 |
| 0 | 0 | 0 | 1 | 1 | 1 | 1 | 0 |
| 0 | 0 | 0 | 1 | 1 | 1 | 1 | 0 |
| 0 | 0 | 0 | 1 | 1 | 1 | 1 | 0 |
| 0 | 0 | 0 | 1 | 1 | 1 | 1 | 0 |
| 0 | 0 | 0 | 1 | 1 | 1 | 1 | 0 |
| 0 | 0 | 0 | 1 | 1 | 1 | 1 | 0 |
| 0 | 0 | 0 | 1 | 1 | 1 | 1 | 0 |

DRIVE PATTERN 26

| | | | | | | | |
|---|---|---|---|---|---|---|---|
| 0 | 0 | 0 | 0 | 1 | 1 | 1 | 1 |
| 0 | 0 | 0 | 0 | 1 | 1 | 1 | 1 |
| 0 | 0 | 0 | 0 | 1 | 1 | 1 | 1 |
| 0 | 0 | 0 | 0 | 1 | 1 | 1 | 1 |
| 0 | 0 | 0 | 0 | 1 | 1 | 1 | 1 |
| 0 | 0 | 0 | 0 | 1 | 1 | 1 | 1 |
| 0 | 0 | 0 | 0 | 1 | 1 | 1 | 1 |
| 0 | 0 | 0 | 0 | 1 | 1 | 1 | 1 |

DRIVE PATTERN 27

| | | | | | | | |
|---|---|---|---|---|---|---|---|
| 1 | 0 | 0 | 0 | 0 | 1 | 1 | 1 |
| 1 | 0 | 0 | 0 | 0 | 1 | 1 | 1 |
| 1 | 0 | 0 | 0 | 0 | 1 | 1 | 1 |
| 1 | 0 | 0 | 0 | 0 | 1 | 1 | 1 |
| 1 | 0 | 0 | 0 | 0 | 1 | 1 | 1 |
| 1 | 0 | 0 | 0 | 0 | 1 | 1 | 1 |
| 1 | 0 | 0 | 0 | 0 | 1 | 1 | 1 |
| 1 | 0 | 0 | 0 | 0 | 1 | 1 | 1 |

DRIVE PATTERN 28

| | | | | | | | |
|---|---|---|---|---|---|---|---|
| 1 | 1 | 0 | 0 | 0 | 0 | 1 | 1 |
| 1 | 1 | 0 | 0 | 0 | 0 | 1 | 1 |
| 1 | 1 | 0 | 0 | 0 | 0 | 1 | 1 |
| 1 | 1 | 0 | 0 | 0 | 0 | 1 | 1 |
| 1 | 1 | 0 | 0 | 0 | 0 | 1 | 1 |
| 1 | 1 | 0 | 0 | 0 | 0 | 1 | 1 |
| 1 | 1 | 0 | 0 | 0 | 0 | 1 | 1 |
| 1 | 1 | 0 | 0 | 0 | 0 | 1 | 1 |

DRIVE PATTERN 29

| | | | | | | | |
|---|---|---|---|---|---|---|---|
| 1 | 1 | 1 | 0 | 0 | 0 | 0 | 1 |
| 1 | 1 | 1 | 0 | 0 | 0 | 0 | 1 |
| 1 | 1 | 1 | 0 | 0 | 0 | 0 | 1 |
| 1 | 1 | 1 | 0 | 0 | 0 | 0 | 1 |
| 1 | 1 | 1 | 0 | 0 | 0 | 0 | 1 |
| 1 | 1 | 1 | 0 | 0 | 0 | 0 | 1 |
| 1 | 1 | 1 | 0 | 0 | 0 | 0 | 1 |
| 1 | 1 | 1 | 0 | 0 | 0 | 0 | 1 |

FIG. 16

FIRST COMPARATIVE EXAMPLE

| | (8n-7)TH ROW | | | | | | | (8n)TH ROW |
|---|---|---|---|---|---|---|---|---|
| FIRST COLUMN | 0 | 0 | 0 | 0 | 0 | 0 | 0 | 0 |
| | 0 | 0 | 0 | 0 | 0 | 0 | 0 | 0 |
| | 0 | 0 | 0 | 0 | 0 | 0 | 0 | 0 |
| | 0 | 0 | 0 | 0 | 0 | 0 | 0 | 0 |
| | 0 | 0 | 0 | 0 | 0 | 0 | 0 | 0 |
| | 0 | 0 | 0 | 0 | 0 | 0 | 0 | 0 |
| | 0 | 0 | 0 | 0 | 0 | 0 | 0 | 0 |
| EIGHTH COLUMN | 0 | 0 | 0 | 0 | 0 | 0 | 0 | 0 |

SECOND COMPARATIVE EXAMPLE

| | (8n-7)TH ROW | | | | | | | (8n)TH ROW |
|---|---|---|---|---|---|---|---|---|
| FIRST COLUMN | 0 | 0 | 0 | 0 | 0 | 0 | 0 | 0 |
| | 1 | 1 | 1 | 1 | 1 | 1 | 1 | 1 |
| | 0 | 0 | 0 | 0 | 0 | 0 | 0 | 0 |
| | 1 | 1 | 1 | 1 | 1 | 1 | 1 | 1 |
| | 0 | 0 | 0 | 0 | 0 | 0 | 0 | 0 |
| | 1 | 1 | 1 | 1 | 1 | 1 | 1 | 1 |
| | 0 | 0 | 0 | 0 | 0 | 0 | 0 | 0 |
| EIGHTH COLUMN | 1 | 1 | 1 | 1 | 1 | 1 | 1 | 1 |

THIRD COMPARATIVE EXAMPLE

| | (8n-7)TH ROW | | | | | | | (8n)TH ROW |
|---|---|---|---|---|---|---|---|---|
| FIRST COLUMN | 0 | 0 | 0 | 0 | 0 | 0 | 0 | 0 |
| | 1 | 1 | 1 | 1 | 1 | 1 | 1 | 1 |
| | 2 | 2 | 2 | 2 | 2 | 2 | 2 | 2 |
| | 3 | 3 | 3 | 3 | 3 | 3 | 3 | 3 |
| | 4 | 4 | 4 | 4 | 4 | 4 | 4 | 4 |
| | 5 | 5 | 5 | 5 | 5 | 5 | 5 | 5 |
| | 6 | 6 | 6 | 6 | 6 | 6 | 6 | 6 |
| EIGHTH COLUMN | 7 | 7 | 7 | 7 | 7 | 7 | 7 | 7 |

Δt IS ASSIGNED FOR EACH ROW

Δt IS ASSIGNED FOR EACH COLUMN

Δt IS ASSIGNED IN ZIGZAG SHAPE

FIG. 21

EIGHTEENTH EMBODIMENT (8n-7)TH ROW (8n)TH ROW

| | | | | | | | | |
|---|---|---|---|---|---|---|---|---|
| FIRST COLUMN | 0 | 1 | 2 | 3 | 0 | 1 | 2 | 3 |
| | 1 | 2 | 3 | 4 | 1 | 2 | 3 | 4 |
| | 2 | 3 | 4 | 5 | 2 | 3 | 4 | 5 |
| | 3 | 4 | 5 | 6 | 3 | 4 | 5 | 6 |
| | 4 | 5 | 6 | 7 | 4 | 5 | 6 | 7 |
| | 5 | 6 | 7 | 8 | 5 | 6 | 7 | 8 |
| | 6 | 7 | 8 | 9 | 6 | 7 | 8 | 9 |
| EIGHTH COLUMN | 7 | 8 | 9 | 10 | 7 | 8 | 9 | 10 |

+

(8n-7)TH ROW (8n)TH ROW

| | | | | | | | | |
|---|---|---|---|---|---|---|---|---|
| FIRST COLUMN | | | | | | | | |
| | Δt | Δt | Δt | Δt | Δt | Δt | Δt | Δt |
| | | | | | | | | |
| | Δt | Δt | Δt | Δt | Δt | Δt | Δt | Δt |
| | | | | | | | | |
| | Δt | Δt | Δt | Δt | Δt | Δt | Δt | Δt |
| | | | | | | | | |
| EIGHTH COLUMN | Δt | Δt | Δt | Δt | Δt | Δt | Δt | Δt |

NINETEENTH EMBODIMENT (8n-7)TH ROW (8n)TH ROW

| | | | | | | | | |
|---|---|---|---|---|---|---|---|---|
| FIRST COLUMN | 0 | 1 | 2 | 1 | 0 | 1 | 2 | 1 |
| | 1 | 2 | 3 | 2 | 1 | 2 | 3 | 2 |
| | 2 | 3 | 4 | 3 | 2 | 3 | 4 | 3 |
| | 3 | 4 | 5 | 4 | 3 | 4 | 5 | 4 |
| | 4 | 5 | 6 | 5 | 4 | 5 | 6 | 5 |
| | 3 | 4 | 5 | 4 | 3 | 4 | 5 | 4 |
| | 2 | 3 | 4 | 3 | 2 | 3 | 4 | 3 |
| EIGHTH COLUMN | 1 | 2 | 3 | 2 | 1 | 2 | 3 | 2 |

+

(8n-7)TH ROW (8n)TH ROW

| | | | | | | | | |
|---|---|---|---|---|---|---|---|---|
| FIRST COLUMN | | | | | | | | |
| | Δt | Δt | Δt | Δt | Δt | Δt | Δt | Δt |
| | | | | | | | | |
| | Δt | Δt | Δt | Δt | Δt | Δt | Δt | Δt |
| | | | | | | | | |
| | Δt | Δt | Δt | Δt | Δt | Δt | Δt | Δt |
| | | | | | | | | |
| EIGHTH COLUMN | Δt | Δt | Δt | Δt | Δt | Δt | Δt | Δt |

TWENTIETH EMBODIMENT (8n-7)TH ROW (8n)TH ROW

| | | | | | | | | |
|---|---|---|---|---|---|---|---|---|
| FIRST COLUMN | 0 | 1 | 2 | 3 | 0 | 1 | 2 | 3 |
| | 1 | 2 | 3 | 4 | 1 | 2 | 3 | 4 |
| | 2 | 3 | 4 | 5 | 2 | 3 | 4 | 5 |
| | 3 | 4 | 5 | 6 | 3 | 4 | 5 | 6 |
| | 4 | 5 | 6 | 7 | 4 | 5 | 6 | 7 |
| | 3 | 4 | 5 | 6 | 3 | 4 | 5 | 6 |
| | 2 | 3 | 4 | 5 | 2 | 3 | 4 | 5 |
| EIGHTH COLUMN | 1 | 2 | 3 | 4 | 1 | 2 | 3 | 4 |

+

(8n-7)TH ROW (8n)TH ROW

| | | | | | | | | |
|---|---|---|---|---|---|---|---|---|
| FIRST COLUMN | | | | | | | | |
| | Δt | Δt | Δt | Δt | Δt | Δt | Δt | Δt |
| | | | | | | | | |
| | Δt | Δt | Δt | Δt | Δt | Δt | Δt | Δt |
| | | | | | | | | |
| | Δt | Δt | Δt | Δt | Δt | Δt | Δt | Δt |
| | | | | | | | | |
| EIGHTH COLUMN | Δt | Δt | Δt | Δt | Δt | Δt | Δt | Δt |

FIG. 23

TWENTY-FIRST EMBODIMENT (8n-7)TH ROW (8n)TH ROW

| | | | | | | | | |
|---|---|---|---|---|---|---|---|---|
| FIRST COLUMN | 0 | 1 | 2 | 3 | 0 | 1 | 2 | 3 |
| | 1 | 2 | 3 | 4 | 1 | 2 | 3 | 4 |
| | 2 | 3 | 4 | 5 | 2 | 3 | 4 | 5 |
| | 3 | 4 | 5 | 6 | 3 | 4 | 5 | 6 |
| | 4 | 5 | 6 | 7 | 4 | 5 | 6 | 7 |
| | 5 | 6 | 7 | 8 | 5 | 6 | 7 | 8 |
| | 6 | 7 | 8 | 9 | 6 | 7 | 8 | 9 |
| EIGHTH COLUMN | 7 | 8 | 9 | 10 | 7 | 8 | 9 | 10 |

+

(8n-7)TH ROW (8n)TH ROW

| | | | | | | | | |
|---|---|---|---|---|---|---|---|---|
| FIRST COLUMN | | | | | | | | |
| | Δt | Δt | Δt | Δt | Δt | Δt | Δt | Δt |
| | | | | | | | | |
| | Δt | Δt | Δt | Δt | Δt | Δt | Δt | Δt |
| | | | | | | | | |
| | Δt | Δt | Δt | Δt | Δt | Δt | Δt | Δt |
| | | | | | | | | |
| EIGHTH COLUMN | Δt | Δt | Δt | Δt | Δt | Δt | Δt | Δt |

TWENTY-SECOND EMBODIMENT (8n-7)TH ROW (8n)TH ROW

| | | | | | | | | |
|---|---|---|---|---|---|---|---|---|
| FIRST COLUMN | 0 | 1 | 2 | 1 | 0 | 1 | 2 | 1 |
| | 1 | 2 | 3 | 2 | 1 | 2 | 3 | 2 |
| | 2 | 3 | 4 | 3 | 2 | 3 | 4 | 3 |
| | 3 | 4 | 5 | 4 | 3 | 4 | 5 | 4 |
| | 4 | 5 | 6 | 5 | 4 | 5 | 6 | 5 |
| | 3 | 4 | 5 | 4 | 3 | 4 | 5 | 4 |
| | 2 | 3 | 4 | 3 | 2 | 3 | 4 | 3 |
| EIGHTH COLUMN | 1 | 2 | 3 | 2 | 1 | 2 | 3 | 2 |

+

(8n-7)TH ROW (8n)TH ROW

| | | | | | | | | |
|---|---|---|---|---|---|---|---|---|
| FIRST COLUMN | | | | | | | | |
| | Δt | Δt | Δt | Δt | Δt | Δt | Δt | Δt |
| | | | | | | | | |
| | Δt | Δt | Δt | Δt | Δt | Δt | Δt | Δt |
| | | | | | | | | |
| | Δt | Δt | Δt | Δt | Δt | Δt | Δt | Δt |
| | | | | | | | | |
| EIGHTH COLUMN | Δt | Δt | Δt | Δt | Δt | Δt | Δt | Δt |

TWENTY-THIRD EMBODIMENT (8n-7)TH ROW (8n)TH ROW

| | | | | | | | | |
|---|---|---|---|---|---|---|---|---|
| FIRST COLUMN | 0 | 1 | 2 | 3 | 0 | 1 | 2 | 3 |
| | 1 | 2 | 3 | 4 | 1 | 2 | 3 | 4 |
| | 2 | 3 | 4 | 5 | 2 | 3 | 4 | 5 |
| | 3 | 4 | 5 | 6 | 3 | 4 | 5 | 6 |
| | 4 | 5 | 6 | 7 | 4 | 5 | 6 | 7 |
| | 3 | 4 | 5 | 6 | 3 | 4 | 5 | 6 |
| | 2 | 3 | 4 | 5 | 2 | 3 | 4 | 5 |
| EIGHTH COLUMN | 1 | 2 | 3 | 4 | 1 | 2 | 3 | 4 |

+

(8n-7)TH ROW (8n)TH ROW

| | | | | | | | | |
|---|---|---|---|---|---|---|---|---|
| FIRST COLUMN | | | | | | | | |
| | Δt | Δt | Δt | Δt | Δt | Δt | Δt | Δt |
| | | | | | | | | |
| | Δt | Δt | Δt | Δt | Δt | Δt | Δt | Δt |
| | | | | | | | | |
| | Δt | Δt | Δt | Δt | Δt | Δt | Δt | Δt |
| | | | | | | | | |
| EIGHTH COLUMN | Δt | Δt | Δt | Δt | Δt | Δt | Δt | Δt |

FIG. 25

TWENTY-FOURTH EMBODIMENT (8n-7)TH ROW (8n)TH ROW

| | | | | | | | | |
|---|---|---|---|---|---|---|---|---|
| FIRST COLUMN | 0 | 1 | 2 | 3 | 0 | 1 | 2 | 3 |
| | 1 | 2 | 3 | 4 | 1 | 2 | 3 | 4 |
| | 2 | 3 | 4 | 5 | 2 | 3 | 4 | 5 |
| | 3 | 4 | 5 | 6 | 3 | 4 | 5 | 6 |
| | 4 | 5 | 6 | 7 | 4 | 5 | 6 | 7 |
| | 5 | 6 | 7 | 8 | 5 | 6 | 7 | 8 |
| | 6 | 7 | 8 | 9 | 6 | 7 | 8 | 9 |
| EIGHTH COLUMN | 7 | 8 | 9 | 10 | 7 | 8 | 9 | 10 |

+

(8n-7)TH ROW (8n)TH ROW

| | | | | | | | | |
|---|---|---|---|---|---|---|---|---|
| FIRST COLUMN | | Δt | | Δt | | Δt | | Δt |
| | Δt | | Δt | | Δt | | Δt | |
| | | Δt | | Δt | | Δt | | Δt |
| | Δt | | Δt | | Δt | | Δt | |
| | | Δt | | Δt | | Δt | | Δt |
| | Δt | | Δt | | Δt | | Δt | |
| | | Δt | | Δt | | Δt | | Δt |
| EIGHTH COLUMN | Δt | | Δt | | Δt | | Δt | |

TWENTY-FIFTH EMBODIMENT (8n-7)TH ROW (8n)TH ROW

| | | | | | | | | |
|---|---|---|---|---|---|---|---|---|
| FIRST COLUMN | 0 | 1 | 2 | 1 | 0 | 1 | 2 | 1 |
| | 1 | 2 | 3 | 2 | 1 | 2 | 3 | 2 |
| | 2 | 3 | 4 | 3 | 2 | 3 | 4 | 3 |
| | 3 | 4 | 5 | 4 | 3 | 4 | 5 | 4 |
| | 4 | 5 | 6 | 5 | 4 | 5 | 6 | 5 |
| | 3 | 4 | 5 | 4 | 3 | 4 | 5 | 4 |
| | 2 | 3 | 4 | 3 | 2 | 3 | 4 | 3 |
| EIGHTH COLUMN | 1 | 2 | 3 | 2 | 1 | 2 | 3 | 2 |

+

(8n-7)TH ROW (8n)TH ROW

| | | | | | | | | |
|---|---|---|---|---|---|---|---|---|
| FIRST COLUMN | | Δt | | Δt | | Δt | | Δt |
| | Δt | | Δt | | Δt | | Δt | |
| | | Δt | | Δt | | Δt | | Δt |
| | Δt | | Δt | | Δt | | Δt | |
| | | Δt | | Δt | | Δt | | Δt |
| | Δt | | Δt | | Δt | | Δt | |
| | | Δt | | Δt | | Δt | | Δt |
| EIGHTH COLUMN | Δt | | Δt | | Δt | | Δt | |

TWENTY-SIXTH EMBODIMENT (8n-7)TH ROW (8n)TH ROW

| | | | | | | | | |
|---|---|---|---|---|---|---|---|---|
| FIRST COLUMN | 0 | 1 | 2 | 3 | 0 | 1 | 2 | 3 |
| | 1 | 2 | 3 | 4 | 1 | 2 | 3 | 4 |
| | 2 | 3 | 4 | 5 | 2 | 3 | 4 | 5 |
| | 3 | 4 | 5 | 6 | 3 | 4 | 5 | 6 |
| | 4 | 5 | 6 | 7 | 4 | 5 | 6 | 7 |
| | 3 | 4 | 5 | 6 | 3 | 4 | 5 | 6 |
| | 2 | 3 | 4 | 5 | 2 | 3 | 4 | 5 |
| EIGHTH COLUMN | 1 | 2 | 3 | 4 | 1 | 2 | 3 | 4 |

+

(8n-7)TH ROW (8n)TH ROW

| | | | | | | | | |
|---|---|---|---|---|---|---|---|---|
| FIRST COLUMN | | Δt | | Δt | | Δt | | Δt |
| | Δt | | Δt | | Δt | | Δt | |
| | | Δt | | Δt | | Δt | | Δt |
| | Δt | | Δt | | Δt | | Δt | |
| | | Δt | | Δt | | Δt | | Δt |
| | Δt | | Δt | | Δt | | Δt | |
| | | Δt | | Δt | | Δt | | Δt |
| EIGHTH COLUMN | Δt | | Δt | | Δt | | Δt | |

LIQUID DISCHARGE APPARATUS AND IMAGE FORMING APPARATUS

CROSS-REFERENCE TO RELATED APPLICATIONS

This application is a division of U.S. patent application Ser. No. 16/549,083, filed on Aug. 23, 2019, which is based upon and claims the benefit of priority from Japanese Patent Application No. 2018-159764, filed on Aug. 28, 2018, and 2019-091896, filed on May 15, 2019, the entire contents of each of which are incorporated herein by reference.

FIELD

Embodiments described herein relate generally to a liquid discharge apparatus and an image forming apparatus.

BACKGROUND

In the related art, there is known a liquid discharge apparatus for supplying a predetermined amount of liquid to a predetermined position. The liquid discharge apparatus is mounted on, for example, an ink jet printer, a 3D printer, a dispensing apparatus, or the like. The ink jet printer discharges an ink droplet from an ink jet head to form an image on a surface of a medium. A 3D printer discharges a droplet of a molding material from a molding material discharge head and hardens the droplet to form a three-dimensional molding. A dispensing apparatus discharges a droplet of a sample solution of a particular concentration to a plurality of containers or the like.

In a liquid discharge apparatus including a plurality of nozzles which discharge a liquid when driven by an actuator, there exists a problem of crosstalk. That is, a discharge speed and a discharge amount may change due to a vibration generated when a nearby nozzle discharges a liquid. To suppress the crosstalk, drive timing of the nozzles, such as those arranged in a row direction, can be shifted. However, when the nozzles are arranged in both a row direction and a column direction, the nozzles arranged in the column direction may still be driven in the same drive cycle depending on, for example, a shape of an image or the molding to be formed, and thus it may not be possible to suppress the crosstalk sufficiently.

BRIEF DESCRIPTION OF THE DRAWINGS

FIG. 11 illustrates a matrix in which the delay time is represented by AL.

FIG. 12 illustrates a matrix in first to twelfth embodiments.

FIG. 13 illustrates a matrix in thirteenth to fifteenth embodiments.

FIG. 14 illustrates a discharge pattern for discharging ink at the delay time of the first to fifteenth embodiments.

FIG. 15 illustrates a discharge pattern for discharging the ink at the delay time of the first to fifteenth embodiments.

FIG. 16 illustrates a matrix in first to third comparative examples.

FIG. 21 illustrates a matrix representing a delay time assigned to each nozzle and an arrangement of a nozzle to which a delay time shift Δt is added in eighteenth to twentieth embodiments.

FIG. 23 illustrates a matrix representing a delay time assigned to each nozzle and an arrangement of a nozzle to which a delay time shift Δt is added in twenty-first to twenty-third embodiments.

FIG. 25 illustrates a matrix representing a delay time assigned to each nozzle and an arrangement of a nozzle to which a delay time shift Δt is added in twenty-fourth to twenty-sixth embodiments.

DETAILED DESCRIPTION

Figure 1:
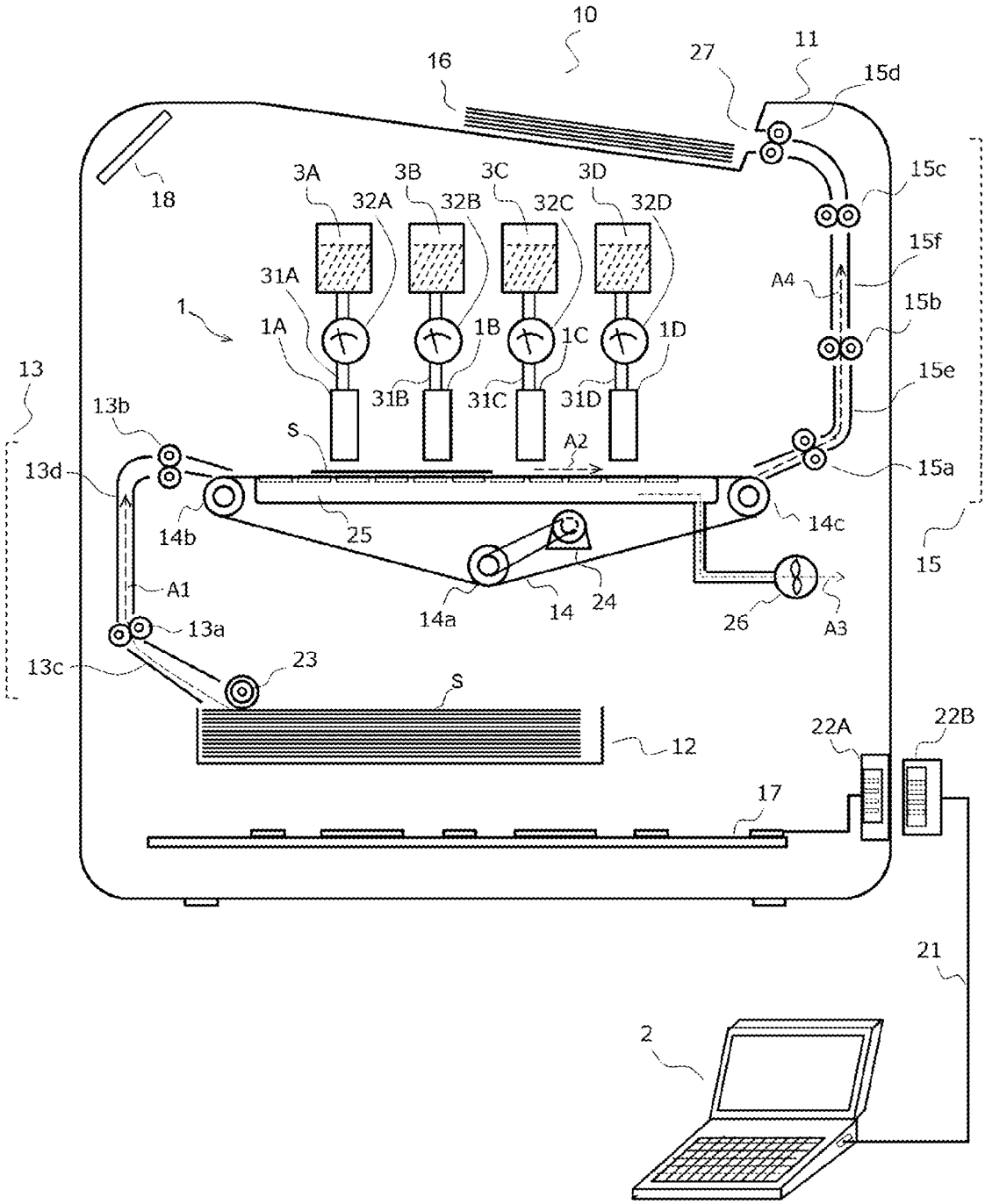
FIG. 1 illustrates an overall configuration of an ink jet printer according to an embodiment.

Embodiments provide a liquid discharge apparatus and an image forming apparatus capable of suppressing crosstalk between nozzles in an array.

In general, according to an embodiment, a liquid discharge apparatus includes a nozzle plate and a drive controller. The nozzle plate includes an array of nozzles arranged in a first direction and a second direction and a plurality of actuators corresponding to the nozzles. The array of nozzles includes first, second, and third nozzles. The first and second nozzles are directly adjacent to each other in the first direction. The first and third nozzles are directly adjacent to each other in the second direction. The plurality of actuators includes first, second, and third actuators corresponding to the first, second, and third nozzles, respectively. The drive controller is configured to apply a drive signal to the first, second, and third actuators during a drive cycle. A difference between a first timing at which the drive signal is applied to the first actuator and a second timing at which the drive signal is applied to the second actuator is an odd number multiple of a half of an inherent vibration cycle of the liquid discharge apparatus. A difference between the first timing and a third timing at which the drive signal is applied to the third actuator is also an odd number multiple of half of the inherent vibration cycle.

Hereinafter, a liquid discharge apparatus and an image forming apparatus according to an embodiment will be described in detail with reference to the accompanying drawings. Further, in each drawing, the same aspect is denoted by the same reference numeral.

An ink jet printer 10 for printing an image on a recording medium will be described as an example of an image forming apparatus on which a liquid discharge apparatus 1 according to an embodiment is mounted. FIG. 1 illustrates a schematic configuration of the ink jet printer 10. The ink jet printer 10 includes, for example, a box-shaped housing 11 which is an exterior body. Inside the housing 11, a cassette 12 for storing a sheet S which is an example of the recording medium, an upstream conveying path 13 of the sheet S, a conveying belt 14 for conveying the sheet S taken out from the inside of the cassette 12, ink jet heads 1A to 1D for discharging an ink droplet toward the sheet S on the conveying belt 14, a downstream conveying path 15 of the sheet S, a discharge tray 16, and a control substrate 17 are disposed. An operation unit 18 which is a user interface is disposed on the upper side of the housing 11.

Data of an image to be printed on the sheet S are generated by, for example, a computer 2 which is an external connection device. The image data generated by the computer 2 are input to the control substrate 17 of the ink jet printer 10 through a cable 21, and connectors 22A and 22B.

A pickup roller 23 supplies the sheets S one by one from the cassette 12 to the upstream conveying path 13. The upstream conveying path 13 includes a pair of feed rollers 13*a* and 13*b* and sheet guide plates 13*c* and 13*d*. The sheet S is sent to an upper surface of the conveying belt 14 via the upstream conveying path 13. An arrow A1 in the drawing indicates a conveying path of the sheet S from the cassette 12 to the conveying belt 14.

The conveying belt 14 is a net-shaped endless belt formed with a large number of through holes on the surface thereof. Three rollers of a drive roller 14*a* and driven rollers 14*b* and 14*c* rotatably support the conveying belt 14. The motor 24 rotates the conveying belt 14 by rotating the drive roller 14*a*. The motor 24 is an example of a drive device. An arrow A2 in the drawing indicates a rotation direction of the conveying belt 14. A negative pressure container 25 is disposed on the back side of the conveying belt 14. The negative pressure container 25 is connected to a pressure reducing fan 26, and the inside thereof becomes a negative pressure due to an air flow generated by the fan 26. The sheet S is adsorbed and held on the upper surface of the conveying belt 14 by allowing the inside of the negative pressure container 25 to become the negative pressure. An arrow A3 in the drawing indicates the air flow.

The ink jet heads 1A to 1D are disposed to be opposite to the sheet S adsorbed and held on the conveying belt 14 with, for example, a narrow gap of 1 mm. The ink jet heads 1A to 1D respectively discharge ink droplets toward the sheet S. An image is formed on the sheet S when the sheet passes below the ink jet heads 1A to 1D. The ink jet heads 1A to 1D have the same structure except that the colors of ink to be discharged therefrom are different. The colors of the ink are, for example, cyan, magenta, yellow, and black.

The ink jet heads 1A to 1D are respectively connected to ink tanks 3A to 3D and ink supply pressure adjusting devices 32A to 32D via ink flow paths 31A to 31D. The ink flow paths 31A to 31D are, for example, resin tubes. The ink tanks 3A to 3D are containers for storing ink. The ink tanks 3A to 3D are respectively disposed above the ink jet heads 1A to 1D. In order to prevent the ink from leaking out from nozzles 51 (refer to FIG. 2) of the ink jet heads 1A to 1D during standby, each of the ink supply pressure adjusting devices 32A to 32D adjusts the inside pressure of each of the ink jet heads 1A to 1D to a negative pressure, for example, −1 kPa with respect to an atmospheric pressure. At the time of image formation, the ink in each of the ink tanks 3A to 3D is supplied to each of the ink jet heads 1A to 1D by the ink supply pressure adjusting devices 32A to 32D.

After the image formation, the sheet S is sent from the conveying belt 14 to the downstream conveying path 15. The downstream conveying path 15 includes a pair of feed rollers 15*a*, 15*b*, 15*c*, and 15*d*, and sheet guide plates 15*e* and 15*f* for defining the conveying path of the sheet S. The sheet S is sent to the discharge tray 16 from a discharge port 27 via the downstream conveying path 15. An arrow A4 in the drawing indicates the conveying path of the sheet S.

A configuration of the ink jet head 1A will be described with reference to FIGS. 2 to 6. Since the ink jet heads 1B to 1D have the same structure as that of the ink jet head 1A, detailed descriptions thereof will be omitted.

Figure 2:
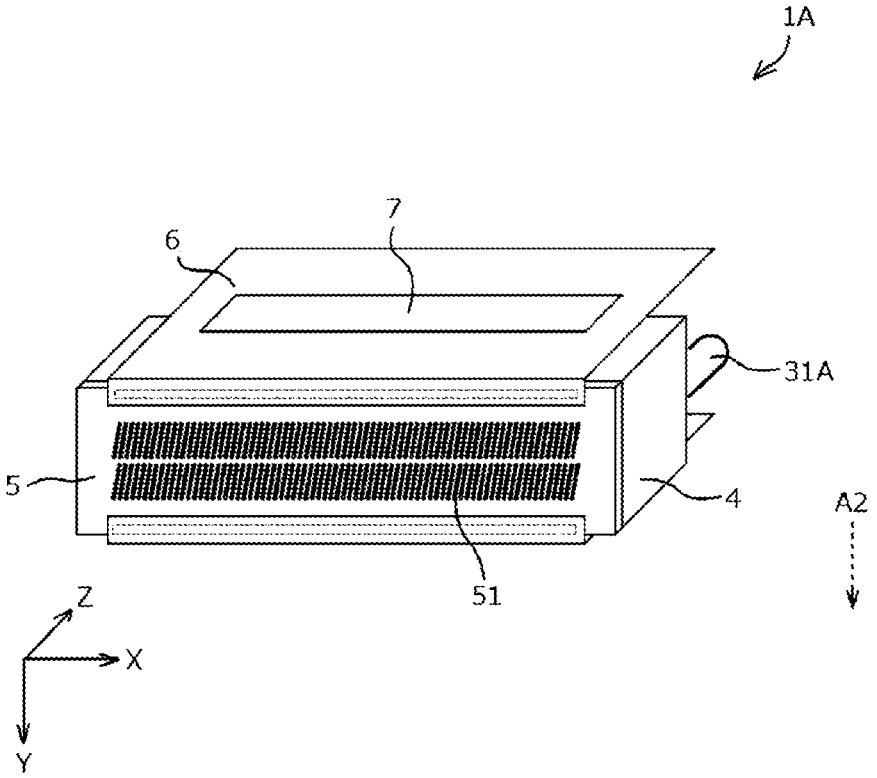
FIG. 2 illustrates a perspective view of an ink jet head.

FIG. 2 illustrates an external perspective view of the ink jet head 1A. The ink jet head 1A includes an ink supply unit 4, a nozzle plate 5, a flexible substrate 6, and a drive circuit 7. The plurality of nozzles 51 for discharging ink are arranged on the nozzle plate 5. The ink to be discharged from each nozzle 51 is supplied from the ink supply unit 4 communicating with the nozzle 51. The ink flow path 31A from the ink supply pressure adjusting device 32A is connected to the upper side of the ink supply unit 4. The drive circuit 7 is an example of a drive signal supply circuit and forms a drive signal supply unit. The arrow A2 indicates the rotation direction of the above-described conveying belt 14 (refer to FIG. 1).

Figure 3:
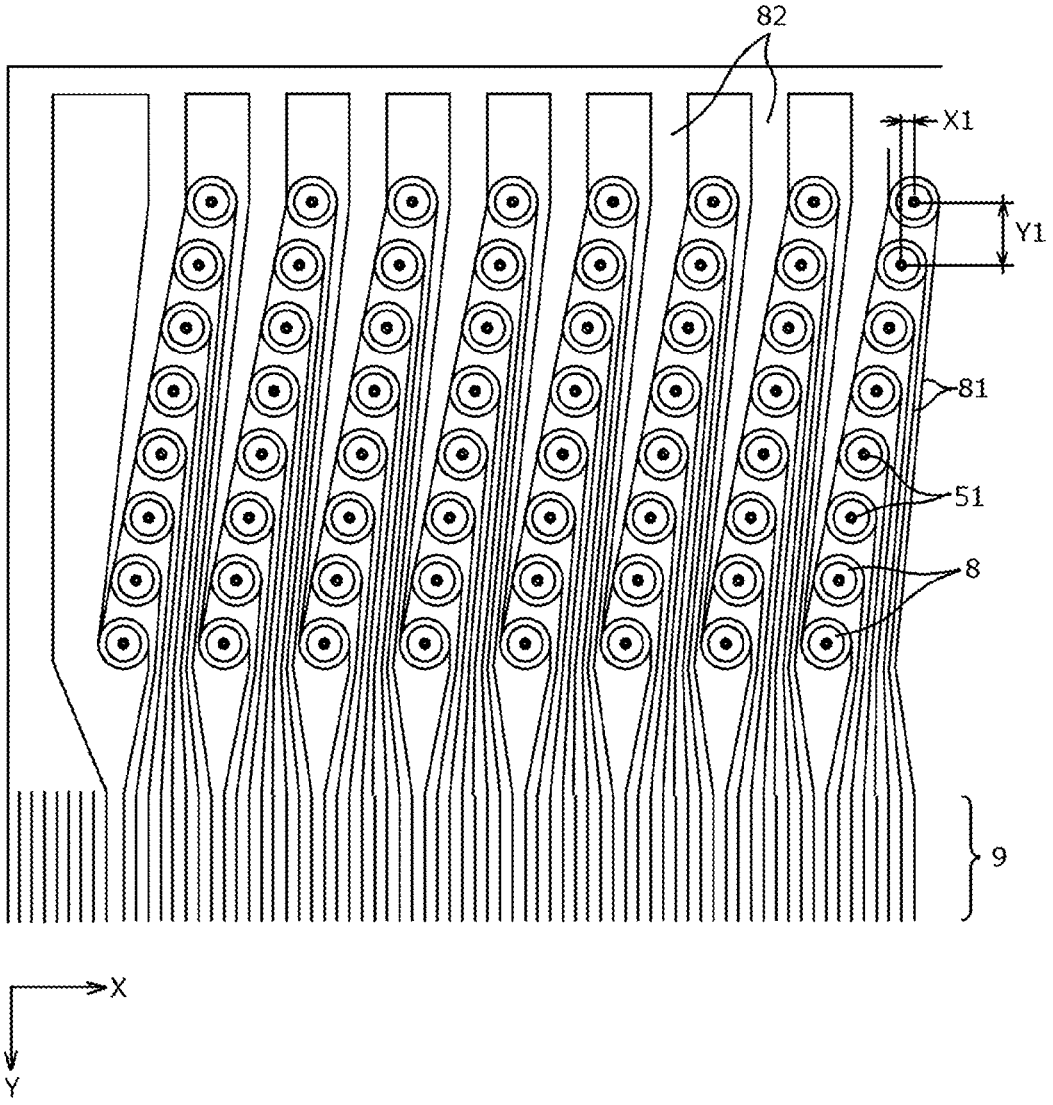
FIG. 3 illustrates a plan view of a nozzle plate.

FIG. 3 illustrates a partially enlarged plan view of the nozzle plate 5. The nozzles 51 are two-dimensionally arranged in a column direction (an X-axis direction) and a row direction (a Y-axis direction). The nozzles 51 arranged in the row direction (the Y-axis direction) may be obliquely arranged so that the nozzles 51 do not overlap on the axial line of the Y axis. The respective nozzles 51 are arranged at a gap of a distance X1 in the X-axis direction and a gap of a distance Y1 in the Y-axis direction. For example, the distance X1 is 42.3 μm and the distance Y1 is 254 μm. That is, the distance X1 is determined so that the recording density becomes 600 DPI in the X-axis direction. Further, the distance Y1 is determined based upon a relationship between a rotational speed of the conveying belt 14 and the time required for the ink to land so that printing is performed at 1,200 DPI in the Y-axis direction. The nozzles 51 are arranged such that 8 pieces of nozzles 51 arranged in the Y-axis direction as one set are plurally arranged in the X-axis direction. Although the illustration thereof is omitted, a total of 1,200 pieces of nozzles 51 are arranged by, for example, arranging 75 sets of nozzles in the X-axis direction and further arranging the 75 sets of nozzles as one group in two groups in the Y-axis direction.

An actuator 8 serving as a drive source of an operation of discharging the ink is provided for each nozzle 51. Each actuator 8 is formed in an annular shape and is arranged so that the nozzle 51 is positioned at the center thereof. The size of the actuator 8 is, for example, 30 μm in an inner diameter and 140 μm in an outer diameter. Each actuator 8 is electrically connected to each individual electrode 81. Further, in each actuator 8, 8 pieces of actuators 8 arranged in the Y-axis direction are electrically connected to each other by a common electrode 82. Each individual electrode 81 and each common electrode 82 are further electrically connected to a mounting pad 9. The mounting pad 9 is an input port for inputting a drive signal (an electric signal) to the actuator 8. Each individual electrode 81 inputs the drive signal to each actuator 8, and each actuator 8 is driven according to the input drive signal. In FIG. 3, for the convenience of description, the actuator 8, the individual electrode 81, the common electrode 82, and the mounting pad 9 are illustrated with a solid line, but the actuator 8, the individual electrode 81, the common electrode 82, and the mounting pad 9 are disposed inside the nozzle plate 5 (refer to a longitudinal cross-sectional view of FIG. 4).

The mounting pad 9 is electrically connected to a wiring pattern formed on the flexible substrate 6 using, for example, an anisotropic conduct film (ACF). Further, the wiring pattern of the flexible substrate 6 is electrically connected to the drive circuit 7. The drive circuit 7 is, for example, an integrated circuit (IC). The drive circuit 7 generates the drive signal to be input to the actuator 8.

Figure 4:
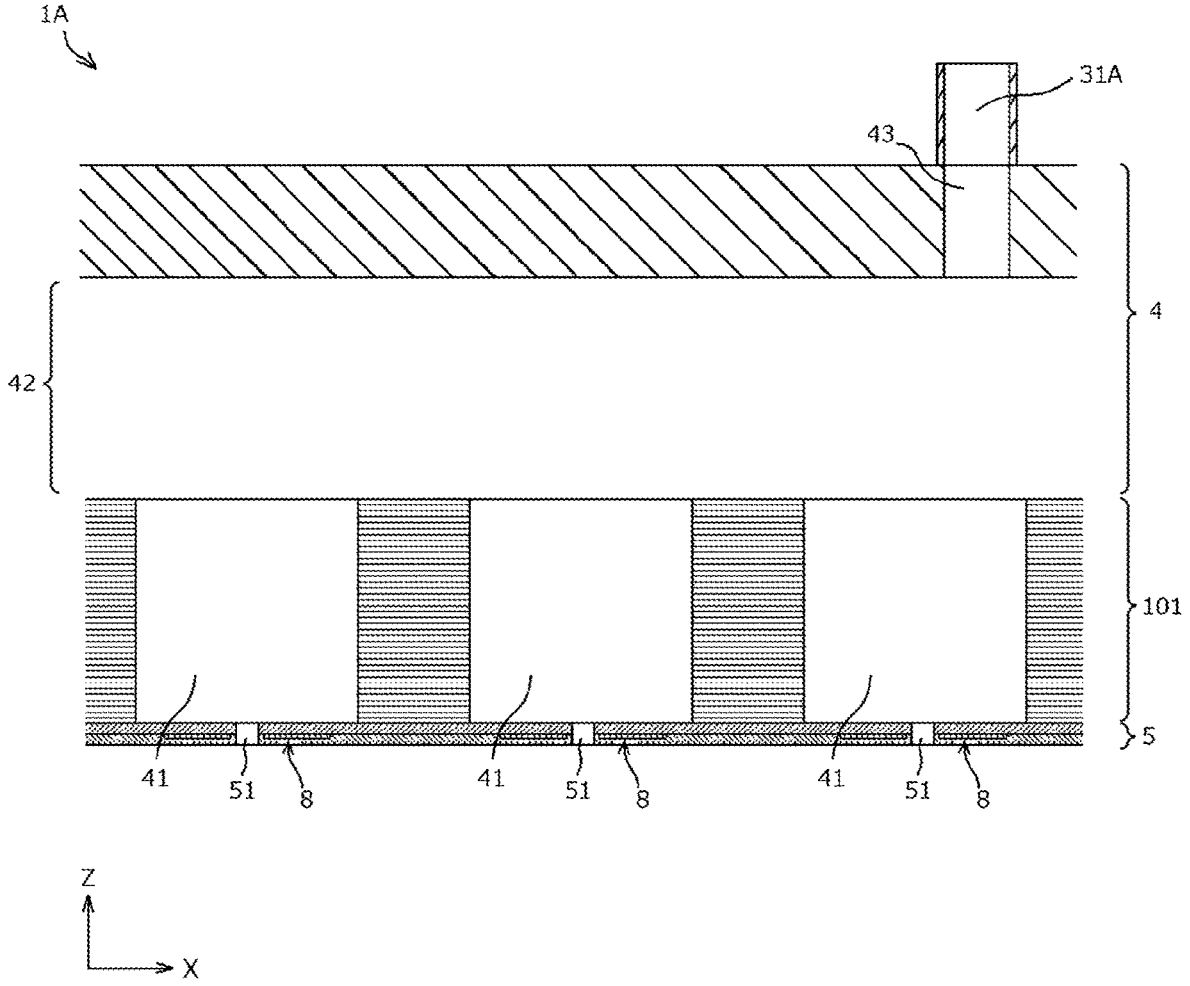
FIG. 4 illustrates a longitudinal cross-sectional view of the ink jet head.

FIG. 4 illustrates a longitudinal cross-sectional view of the ink jet head 1A. As illustrated in FIG. 4, the nozzle 51 penetrates the nozzle plate 5 in a Z-axis direction. The size of the nozzle 51 is, for example, 20 μm in diameter and 8 μm in length. A plurality of pressure chambers (individual pressure chambers) 41 respectively communicating with the nozzles 51 are provided inside a substrate 101. The pressure chamber 41 is, for example, a cylindrical space with an open upper part. The upper part of each pressure chamber 41 is open and communicates with a common ink chamber 42. The ink flow path 31A communicates with the common ink chamber 42 via an ink supply port 43. Each pressure chamber 41 and the common ink chamber 42 are filled with ink. For example, the common ink chamber 42 may be also formed in a flow path shape for circulating the ink. The pressure chamber 41 has a configuration in which, for example, a cylindrical hole having a diameter of 200 μm is formed on a single crystal silicon wafer having a thickness of 500 μm. The ink supply unit 4 has a configuration in which, for example, a space corresponding to the common ink chamber 42 is formed in alumina ($Al_2O_3$).

Figure 5:
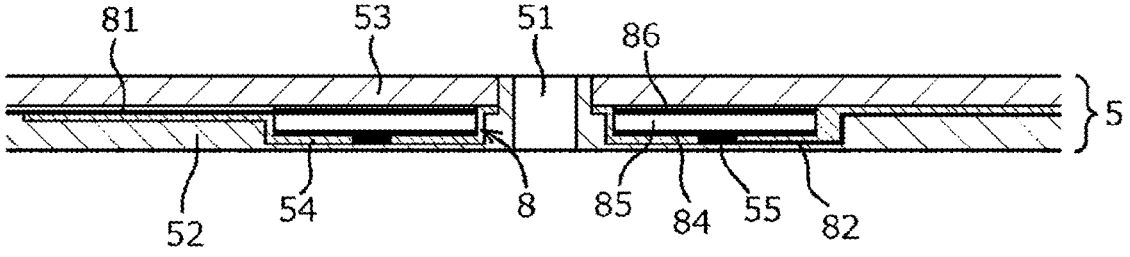
FIG. 5 illustrates a longitudinal cross-sectional view of the nozzle plate.

FIG. 5 illustrates a partially enlarged view of the nozzle plate 5. The nozzle plate 5 has a structure in which a protective layer 52, the actuator 8, and a diaphragm 53 are laminated in order from the bottom surface side. The actuator 8 has a structure in which an upper electrode 84, a thin plate-shaped piezoelectric body 85, and a lower electrode 86 are laminated. The lower electrode 86 is electrically connected to the individual electrode 81, and the upper electrode 84 is electrically connected to the common electrode 82. An insulating layer 54 for preventing a short circuit between the individual electrode 81 and the common electrode 82 is interposed at a boundary between the protective layer 52 and the diaphragm 53. The insulating layer 54 is formed of, for example, a silicon dioxide film ($SiO_2$) having a thickness of 0.5 μm. The upper electrode 84 and the common electrode 82 are electrically connected to each other through a contact hole 55 formed in the insulating layer 54. The piezoelectric body 85 is formed of, for example, lead zirconate titanate (PZT) having a thickness of 5 μm or less in consideration of a piezoelectric characteristic and a dielectric breakdown voltage. The lower electrode 86 and the upper electrode 84 are formed of, for example, platinum having a thickness of 0.15 μm. The individual electrode 81 and the common electrode 82 are formed of, for example, gold (Au) having a thickness of 0.3 μm.

The diaphragm 53 is formed of an insulating inorganic material. The insulating inorganic material is, for example, silicon dioxide ($SiO_2$). A thickness of the diaphragm 53 is, for example, 2 to 10 μm, desirably 4 to 6 μm. Although the details thereof will be described below, the diaphragm 53 and the protective layer 52 curve inwardly as the piezoelectric body 85 to which the voltage is applied is deformed in a $d_{31}$ mode. Then, when the application of the voltage to the piezoelectric body 85 is stopped, the shape of the piezoelectric body 85 is returned to the original state. The reversible deformation allows the volume of the pressure chamber (individual pressure chamber) 41 to expand and contract. When the volume of the pressure chamber 41 changes, an ink pressure in the pressure chamber 41 changes.

The protective layer 52 is formed of, for example, polyimide having a thickness of 4 μm. The protective layer 52 covers one surface on the bottom surface side of the nozzle plate 5 opposite to the sheet S, and further covers an inner peripheral surface of a hole of the nozzle 51.

Figure 6:
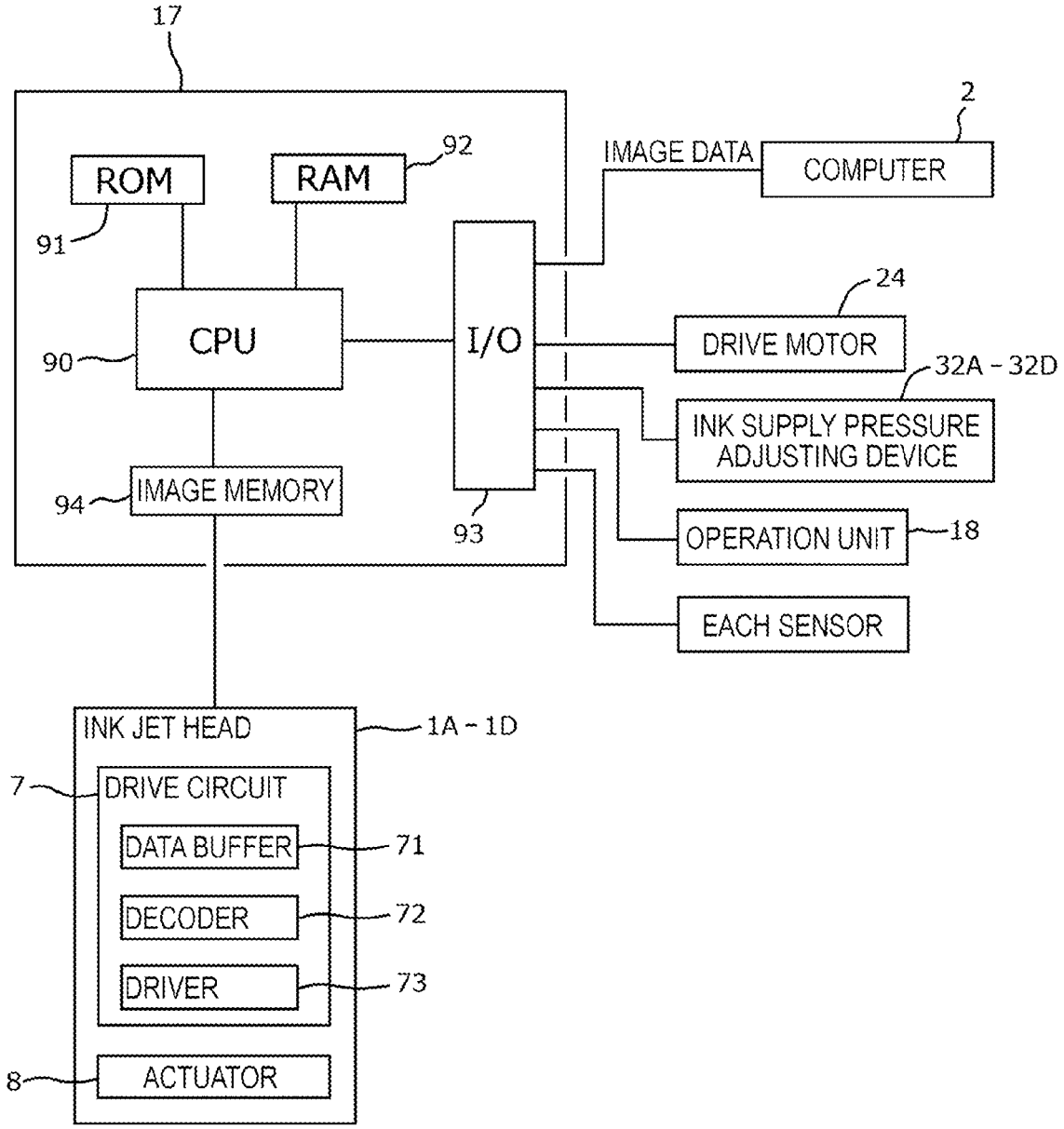
FIG. 6 is a block diagram of a control system.

FIG. 6 is a block diagram of functional components of the ink jet printer 10. The control substrate 17 as a control unit is mounted with a CPU 90, a ROM 91, a RAM 92, an I/O port 93 which is an input and output port, and an image memory 94 thereon. The CPU 90 controls the drive motor 24, the ink supply pressure adjusting devices 32A to 32D, the operation unit 18, and various sensors through the I/O port 93. Print data from the computer 2 which is the external connection device are transmitted to the control substrate 17 through the I/O port 93, and then stored in the image memory 94. The CPU 90 transmits the print data stored in the image memory 94 to the drive circuit 7 in the order of drawing.

The drive circuit 7 includes a print data buffer 71, a decoder 72, and a driver 73. The print data buffer 71 stores the print data in time series for each actuator 8. The decoder 72 controls the driver 73 for each actuator 8 based upon the print data stored in the print data buffer 71. The driver 73 outputs a drive signal for operating each actuator 8 based upon the control of the decoder 72. The drive signal is a voltage to be applied to each actuator 8.

Figure 7:
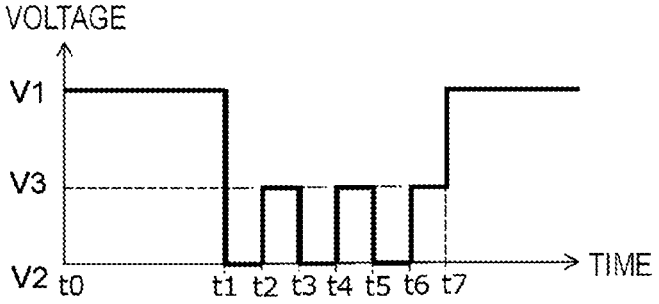
FIG. 7 illustrates a drive signal to be supplied to an actuator.

Next, a waveform (a drive waveform) of the drive signal to be input to the actuator 8 and an operation of discharging the ink from the nozzle 51 will be described with reference to FIGS. 7 and 8A to 8E. FIG. 7 illustrates a multi-drop drive waveform in which an ink droplet is dropped three times in one drive cycle by a triple pulse as an example of the drive waveform. When the ink droplets are dropped at a high speed, the ink droplets become one droplet and land on the sheet S. The drive waveform of FIG. 7 is a so-called pull ejection drive waveform. However, the drive waveform is not limited to the triple pulse. For example, a single pulse or a double pulse may be used therefor. Further, without being limited to the pull ejection drive waveform, push ejection and push-pull ejection may be used.

The drive circuit 7 applies a bias voltage V1 to the actuator 8 from time t0 to time t1. That is, the voltage V1 is applied between the lower electrode 86 and the upper electrode 84. Next, after a voltage V2 (=0 V) is applied from the time t1 when an ink discharge operation starts to time t2, a voltage V3 is applied from the time t2 to time t3, thereby performing a first ink drop. Further, after the voltage V2 (=0 V) is applied from the time t3 to time t4, the voltage V3 is applied from the time t4 to time t5, thereby performing a second ink drop. Further, after the voltage V2 (=0 V) is applied from the time t5 to time t6, the voltage V3 is applied from the time t6 to time t7, thereby performing a third ink drop. When the ink droplets are dropped at a high speed, the ink droplets become one droplet and land on the sheet S. The bias voltage V1 is applied at the time t7 after the completion of the drop, thereby damping the residual vibration in the pressure chamber 41.

The voltage V3 is a voltage smaller than the bias voltage V1, and a voltage value is determined based upon, for example, a damping rate of the pressure vibration of the ink in the pressure chamber 41. Time from the time t1 to the time t2, time from the time t2 to the time t3, time from the time t3 to the time t4, time from the time t4 to the time t5, time from the time t5 to the time t6, and time from the time t6 to the time t7 are respectively set to a half cycle of an inherent vibration cycle λ determined by a characteristic of the ink and a structure in the head. A half cycle of the inherent vibration cycle λ is also referred to as an acoustic length (AL). Further, the voltage of the common electrode 82 is set to be constant at 0 V during the series of operations.

Figure 8A:
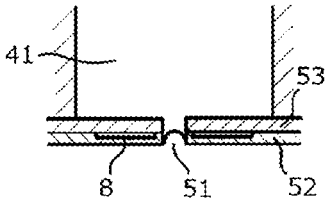
FIGS. 8A to 8E are explanatory diagrams illustrating an operation of the actuator supplied with the drive signal.
Figure 8D:
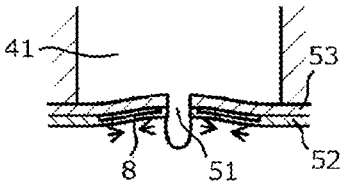
Figure 8B:
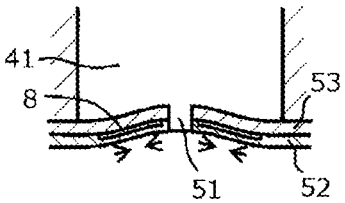

FIGS. 8A to 8E schematically illustrate an operation of discharging the ink by driving the actuator 8 with a drive signal having the waveform of FIG. 7. From the time t0 to the time t1, the operation is in a standby state. When the bias voltage V1 is applied in the standby state, an electric field is generated in a thickness direction of the piezoelectric body 85, and as illustrated in FIG. 8B, deformation of the $d_{31}$ mode is generated in the piezoelectric body 85. Specifically, the annular piezoelectric body 85 expands in the thickness direction and contracts in a radial direction. Bending stress is generated in the diaphragm 53 due to the deformation of the piezoelectric body 85, and the actuator 8 is bent inwardly. That is, the actuator 8 is deformed to form a depression centered on the nozzle 51, whereby the volume of the pressure chamber 41 is contracted.

Figure 8E:
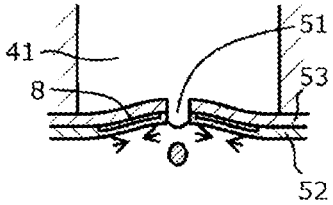
Figure 8C:
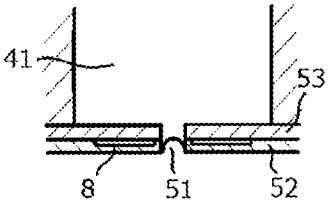

When the voltage V2(=0 V) as an expansion pulse is applied at the time t1, the actuator 8 returns to the state before the deformation as schematically illustrated in FIG. 8C. At this time, the internal ink pressure decreases due to the returning of the volume to the original state in the pressure chamber 41, but the ink pressure increases since the ink is supplied from the common ink chamber 42. Thereafter, at the time t2, the ink supply to the pressure chamber 41 is stopped, such that the increase of the ink pressure is also stopped. That is, the state thereof becomes a so-called pull state.

When the voltage V3 as a contraction pulse is applied at the time t2, the piezoelectric body 85 of the actuator 8 is deformed again such that the volume of the pressure chamber 41 is contracted. As described above, the ink pressure increases between the time t1 and the time t2, and further the ink pressure increases by the pushing with the actuator 8 to decrease the volume of the pressure chamber 41, so that the ink is pushed out from the nozzle 51 as schematically illustrated in FIG. 8D. The application of the voltage V3 continues up to the time t3, and the ink is discharged from the nozzle 51 as a droplet as schematically illustrated in FIG. 8E. That is, the first ink drop is performed.

After the voltage V2 (=0 V) is applied from the time t3 to the time t4, also when the voltage V3 is applied from the time t4 to the time t5, the second ink drop is performed by the same operation and action (FIGS. 8B to 8E). In addition, after the voltage V2 (=0 V) is applied from the time t5 to the time t6, also when the voltage V3 is applied from the time t6 to the time t7, the third ink drop is performed by the same operation and action (FIGS. 8B to 8E).

When the third drop is performed, the voltage V1 as a cancel pulse is applied at the time t7. The ink pressure in the pressure chamber 41 since the ink is discharged. Further, the vibration of the ink remains in the pressure chamber 41. Therefore, the actuator 8 is driven so that the volume of the pressure chamber 41 contracts by applying the voltage from the voltage V3 to the voltage V1, the ink pressure in the pressure chamber 41 is set to substantially zero, and the residual vibration of the ink in the pressure chamber 41 is forcibly damped.

Figure 9:
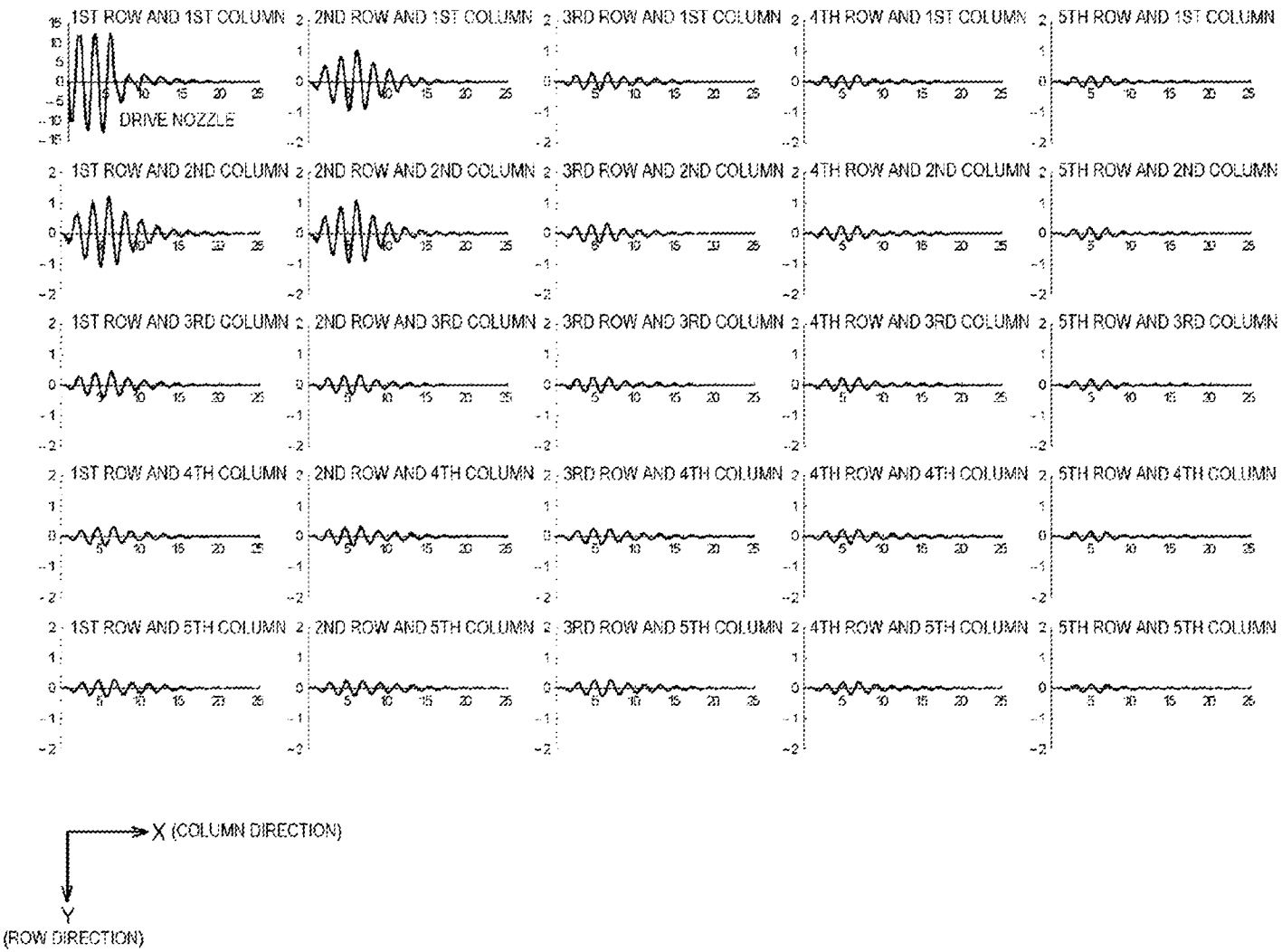
FIG. 9 is an explanatory diagram illustrating a pressure vibration when the actuator is driven.

Here, a flow velocity vibration transmitted to the periphery when the actuator 8 is driven will be described. FIG. 9 illustrates a cycle of the flow velocity vibration to be transmitted to the pressure chamber 41 of the nozzle 51 disposed in the periphery and magnitude of the amplitude thereof, when the ink is discharged by driving the actuator 8 of the nozzle 51 disposed in a first row and a first column. As illustrated in FIG. 9, when the ink is discharged from the nozzle (a drive nozzle) 51 in the first row and the first column, the flow velocity vibrations transmitted to the nozzle 51 in the first row and a second column adjacent in a row direction, the nozzle 51 in a second row and the first column in a column direction, and the nozzle 51 in the second row and the second column adjacent in a diagonal direction are large. Therefore, when the ink is discharged from the adjacent nozzle 51 when the flow velocity vibration from the nozzle 51 in the first row and the first column remains, crosstalk may occur due to the interference. Even though the amplitude thereof is small, the flow velocity vibration is also transmitted to another nozzle 51 disposed at a position farther than the adjacent nozzle 51.

Even when a nozzle 51 other than the nozzle in the first row and the first column is driven, the flow velocity vibration of the same cycle is generated. The reason is that the cycle of the flow velocity vibration generated when the actuator 8 is driven the inherent vibration cycle λ, which is determined by the characteristics of the ink and the structure in the head. That is, the inherent vibration cycle is one determined by the ink in the pressure chamber of the ink jet head 1A. Accordingly, the inherent vibration cycle λ can be measured by detecting a change in impedance of the actuator 8 when the ink is filled therein. For example, an impedance analyzer is used for detecting the impedance. As another method of measuring the inherent vibration cycle λ, an electric signal such as a step waveform, and the like may be supplied from the drive circuit 7 to the actuator 8, and the vibration of the actuator 8 may be measured by a laser Doppler vibrometer. Further, the inherent vibration cycle λ can also be obtained by computation through simulation using a computer.

Figure 10:
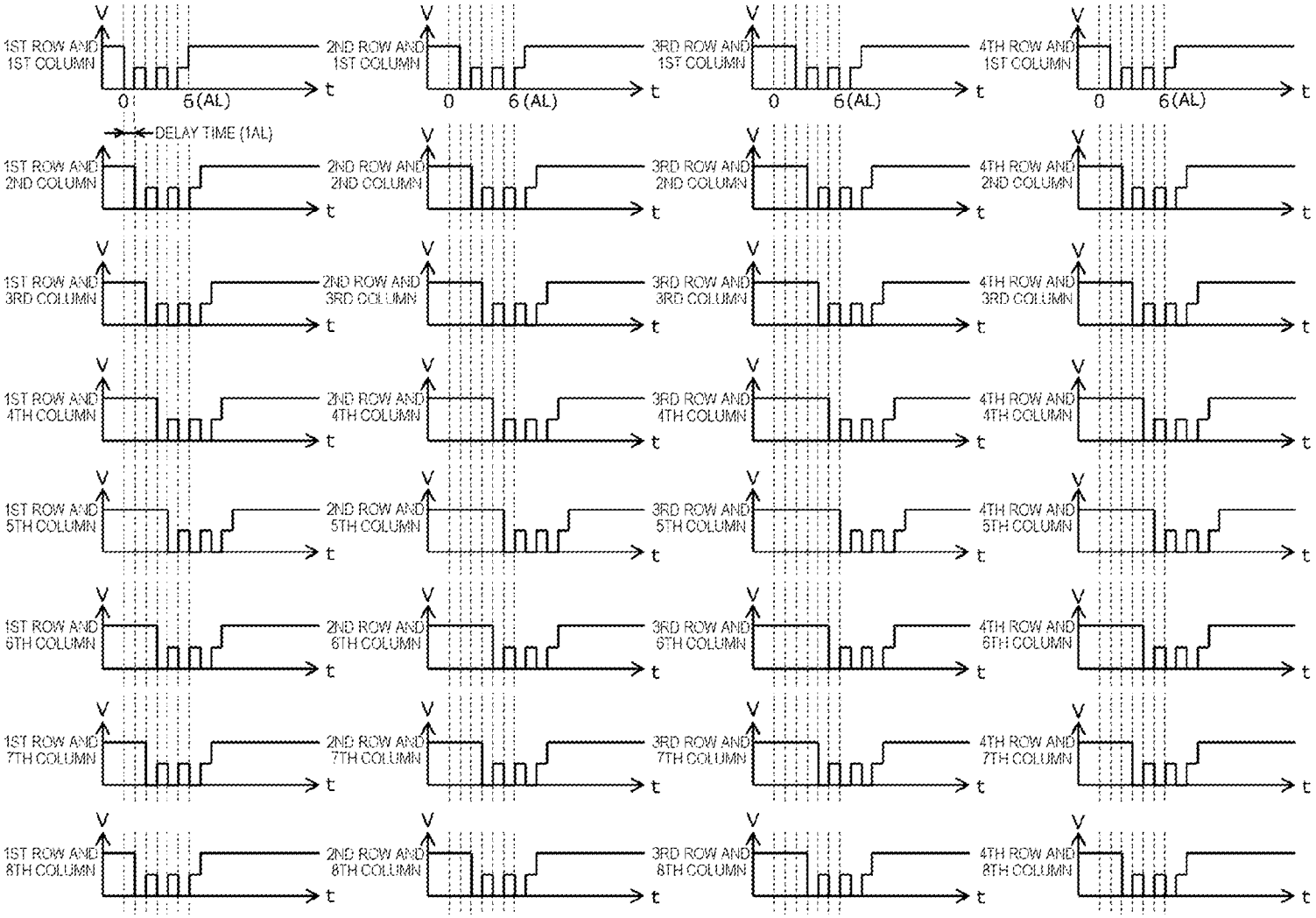
FIG. 10 is an explanatory diagram in which a delay time assigned to each nozzle is represented by a drive waveform.

As illustrated in FIG. 10, the drive signal to be supplied to the actuator 8 of the nozzle 51 arranged in an array shape has a time difference of a half cycle of the inherent vibration cycle λ with the drive timings of the nozzles 51 adjacent to each other in the row direction, and the drive timing is set so that the drive timings of the nozzles 51 adjacent to each other in the column direction also mutually have the time difference of a half cycle of the inherent vibration cycle λ. When the time difference of a half cycle is set, either one of the nozzles 51 adjacent to each other may be driven first. For example, the nozzle 51 in the first row and the second column adjacent in the row direction when viewed from the nozzle 51 in the first row and the first column delays the drive timing with respect to the nozzle 51 in the first row and the first column, and the delay time is defined as a half cycle of the inherent vibration cycle λ. Further, the nozzle 51 in the second row and the first column adjacent in the column direction when viewed from the nozzle 51 in the first row and the first column also delays the drive timing with respect to the nozzle 51 in the first row and the first column, and the delay time is defined as a half cycle of the inherent vibration cycle λ. Even when another nozzle 51 other than the nozzle in the first row and the first column is noticed, another nozzle 51 mutually delays the drive timing by a half cycle of the inherent vibration cycle λ with respect to the nozzles 51 adjacent to each other in the row direction and the column direction.

The delay time is set at an interval of every half cycle of the inherent vibration cycle λ. That is, when a half cycle of the inherent vibration cycle λ is represented by an acoustic length (AL), the delay time is set to be an odd number multiple of AL (1 AL, 3 AL, 5 AL, . . . , n AL). FIG. 11 illustrates a matrix in which the delay time assigned to each of the nozzles 51 in FIG. 10 is represented by AL. Specifically, the delay time assigned to each of the nozzles 51 in FIG. 10 is defined as one group, and two of the one group are arranged in the column direction, thereby forming a matrix of 64 pieces (=8 columns×8 rows). For the numerical value in the frame, the drive timing of the nozzle in the first row and the first column is set as a reference (=0), and the delay time of another nozzle 51 is indicated by a multiple of AL (unit; AL).

As illustrated in FIG. 11, even when either one of the nozzles 51 is noticed, the drive timing of the nozzle 51 adjacent in the row direction when viewed from the noticed nozzle is the odd number multiple of AL, and the drive timing of the nozzle 51 adjacent in the column direction when viewed from the noticed nozzle is the odd number multiple of AL. Further, the nozzle 51 having the same numerical value in the frame is driven at the same timing in the same drive cycle. In FIG. 11, the delay times of 64 pieces of the nozzles 51 (=8×8) are illustrated in the matrix, and by further arranging the matrix in the row direction and/or the column direction, whereby it is possible to set the delay time of a larger number of nozzles 51.

With respect to the setting of the delay time, as can be seen from the matrix in FIG. 11, when the delay time of the i-th nozzle 51 in the row direction is defined as $a_i$ and the delay time of the j-th nozzle 51 in the column direction is defined as $b_j$, the delay time of the nozzle 51 in the i-th row and the j-th column is set to $a_i+b_j$. For example, the delay time (4 AL) of the nozzle 51 in the third row and the third column becomes a value obtained by adding the delay time (2 AL) of the third nozzle 51 in the row direction (in the third row and the first column) and the delay time (2 AL) of the third nozzle 51 in the column direction (in the first row and the third column). For another nozzle 51, the same rule as descried above is applied. According to the rule described above, the drive timing of many nozzles 51 can be easily set.

Further, when the delay time of the nozzle 51 in the i-th row and the j-th column which is in the i-th position in the row direction and the j-th position in the column direction is defined as $a_{i,j}$; a delay time of the nozzle 51 in the (i+1)th row and the (j−1)th column is defined as $a_{i+1,j-1}$; and a delay time of the nozzle 51 in the (i+1)th row and (j+1)th column is defined as $a_{i+1,j+1}$, it is also possible to include the nozzle 51 whose delay time is defined as $a_{i,j}$=the delay time $a_{i+1,j-1}$ or whose delay time is defined as $a_{i,j}$=the delay time $a_{i+1,j+1}$.

Further, as described above, in the drive waveform of FIG. 7, the time intervals from the time t1 to the time t2, from the time t2 to the time t3, from the time t3 to the time t4, from the time t4 to the time t5, from the time t5 to time t6, and from the time t6 to time t7 are also defined as 1 AL. The time interval is not limited to 1 AL, and may be an odd number multiple of AL. That is, after the drive start of the actuator 8, the timing of changing the voltage to the voltages V1, V2, and V3 also becomes an interval of every half cycle of the inherent vibration cycle λ.

When each actuator 8 is driven at the delay time which is the odd number multiple of AL as illustrated in the matrix of FIG. 11, the pressure vibrations of the nozzles 51 adjacent to each other in the row direction cancel each other in the common ink chamber 42 by shifting each of the cycles by a half cycle. Similarly, the pressure vibrations of the nozzles 51 adjacent to each other in the column direction cancel each other in the common ink chamber 42 by shifting each of the cycles by a half cycle. Further, since the drive timing of changing the voltages (V1, V2, and V3) thereafter is also set at the interval of each half cycle of the inherent vibration cycle λ, the pressure vibrations generated by changing the voltages also cancel each other in the common ink chamber 42. Without being limited to the nozzles 51 adjacent to each other, the pressure vibrations from the nozzles 51 whose drive timing becomes the delay time of the odd number multiple of AL cancel each other because the cycles are shifted from each other by a half cycle. However, as can be seen from the results of FIG. 9, since the flow velocity vibrations transmitted to the nozzle 51 adjacent in the row direction and the nozzle 51 adjacent in the column direction are large, the advantage of suppressing the influence of the pressure vibrations from the nozzles 51 adjacent to each other in the row direction and the column direction is large.

According to the above-described embodiment, the pressure vibrations of the adjacent nozzles 51 can cancel each other by providing the delay time of the odd number multiple of AL at the drive timing of the nozzles 51 adjacent to each other in the row direction and the column direction. Further, by providing the delay time of the odd number multiple of AL not only in the row direction but also in the column direction, the possibility of coincidence of the delay time in the same drive cycle can be reduced with respect to various printing patterns. As a result, the crosstalk can be suppressed regardless of the printing patterns, whereby deterioration of the printing quality can be prevented.

Example Embodiments

Next, certain non-limiting examples utilized for confirming various operational aspects of the above-described embodiment will be described.

In these example embodiments, various delay times are set to the respective nozzles 51, and a change in a discharge speed when the ink is discharged by driving the actuator 8 is simulated. Various discharge patterns are set in order to confirm that crosstalk is suppressed regardless of the printing patterns. When the change in the discharge speed is small, the crosstalk can be suppressed.

FIG. 12 illustrates a set value of a delay time according to first to twelfth embodiments. In the first, second, third, fifth, sixth, seventh, ninth, tenth, and eleventh embodiments, when a delay time of the i-th nozzle 51 in the row direction is defined as $a_i$ and a delay time of the j-th nozzle 51 in the column direction is defined as $b_j$, a delay time of the nozzle 51 in the i-th row and the j-th column is set to $a_i+b_j$. On the other hand, in the fourth, eighth, and twelfth embodiments, when a delay time of the nozzle 51 in the i-th row and the j-th column is defined as $a_{i,j}$, a delay time of the nozzle 51 in the (i+1)th row and the (j−1)th column is defined as $a_{i+1,j-1}$, and a delay time of the nozzle 51 in the (i+1)th row and the (j+1)th column is defined as $a_{i+1,j+1}$, the delay time $a_{i,j}$=the delay time $a_{i+1,j-1}$ or the delay time $a_{i,j}$=the delay time $a_{i+1,j+1}$ is set.

FIG. 13 illustrates a set value of a delay time according to thirteenth to sixteenth embodiments. The thirteenth to sixteenth embodiments illustrate a set value of a delay time of each nozzle 51 when a drive cycle is divided into two. That is, for example, in the thirteenth to fifteenth embodiments, ink is discharged from the nozzle 51 in an odd number row in the first drive cycle, and the ink is discharged from the nozzle 51 of an even number row in the second drive cycle. Further, in the sixteenth embodiment, the drive cycle is divided into two to have a checkered pattern. The adjacent nozzles 51 in the thirteenth to sixteenth embodiments are adjacent nozzles 51 among the nozzles 51 that discharge the ink in the same drive cycle. Therefore, for example, in the case of the thirteenth embodiment, the nozzle 51 adjacent to the nozzle 51 in the first row and the first column in the row direction in the same drive cycle becomes the nozzle 51 in the third row and the first column. The nozzle 51 adjacent thereto in the column direction in the same drive cycle becomes the nozzle 51 in the first row and the second column.

Also in the thirteenth to fifteenth embodiments, when a delay time of the i-th nozzle 51 in the row direction is defined as $a_i$ and a delay time of the j-th nozzle 51 in the column direction is defined as $b_j$, the nozzle 51 in the i-th row and the j-th column whose delay time is defined as $a_i+b_j$ is included. Further, in the sixteenth embodiment, when a delay time of the nozzle 51 in the i-th row and the j-th column which is in the i-th position in the row direction and in the j-th position in the column direction is defined as $a_{i,j}$; a delay time of the nozzle 51 in the (i+1)th row and the (j−1)th column is defined as $a_{i+1,j-1}$; and a delay time of the nozzle 51 in the (i+1)th row and the (j+1)th column is defined as $a_{i+1,j+1}$, the nozzle 51 whose delay time is defined as $a_{i,j}$=the delay time $a_{i+1,j-1}$ or whose delay time is defined as $a_{1,j}$=the delay time $a_{i+1,j+1}$ is included.

FIGS. 14 and 15 illustrate various discharge patterns 1 to 29. As described above, the ink is not discharged from all the nozzles 51 in the same drive cycle. There are nozzles for discharging the ink and nozzles for not discharging the ink depending on a shape of the image to be printed. The discharge patterns 1 to 29 are patterns in which discharge patterns empirically having a high frequency are systematized into 64 pieces (8 rows×8 columns) of matrixes. Further, with respect to the respective one to sixteenth embodiments, a change in a discharge speed when the ink is discharged is simulated with the discharge patterns 1 to 29. Further, as a comparison, the change in the discharge speed when the ink is discharged is simulated with the discharge patterns 1 to 29 in the same manner also for each of the first to third comparative examples in FIG. 16.

Figure 17:
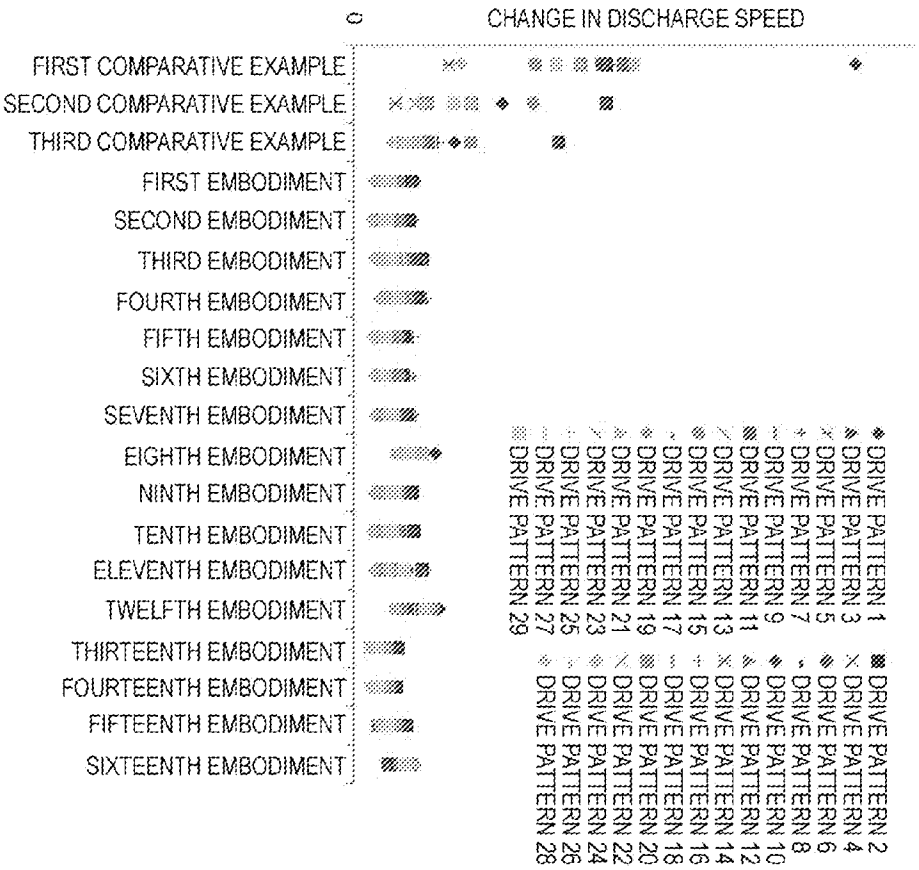
FIG. 17 is a graph illustrating a result of a change in a discharge speed when ink is discharged in the first to fifteenth embodiments and the first to third comparative examples.

FIG. 17 illustrates a result of the change in the discharge speed of the respective one to sixteenth embodiments and the respective first to third comparative examples. As can be seen from the result of FIG. 17, the change in the discharge speed can be reduced by setting the delay time of the odd number multiple of AL at the drive timing of the nozzles 51 adjacent to each other in the row direction and the column direction. That is, crosstalk can be suppressed. On the other hand, in the first to third comparative examples, the change in the discharge speed is large. The change in the discharge speed due to the crosstalk becomes one factor causing the deterioration of printing quality.

Figure 18:
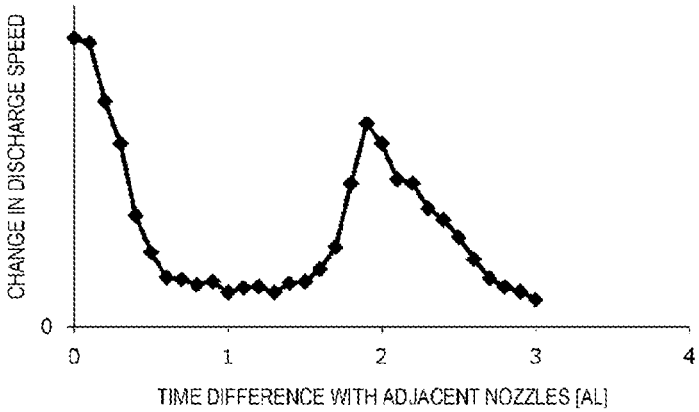
FIG. 18 is a graph illustrating a result of a change in a discharge speed in the first embodiment.

Next, a seventeenth embodiment will be described. The seventeenth embodiment shows a result obtained by simulating a change in a discharge speed when the delay time of the drive timing is variously set in the range of 0 to 3 AL at the 0.1 AL interval. As is evident from the result of FIG. 18, the change in the discharge speed can be suppressed by setting the delay time thereof in the range of 0.6 AL to 1.5 AL. Further, the change in the discharge speed can be suppressed by setting the delay time thereof in the range of 2.8 AL to 3 AL.

Figure 19:
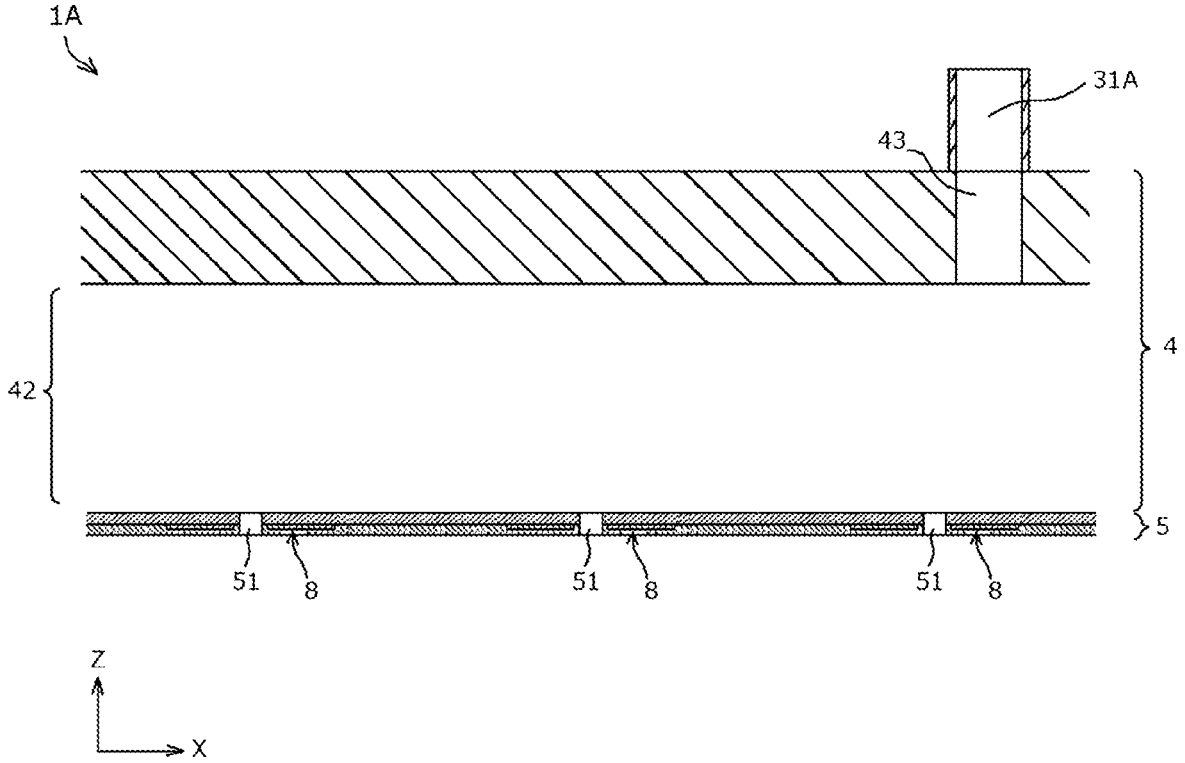
FIG. 19 illustrates a longitudinal cross-sectional view of a modification of the ink jet head.

As a modification of the ink jet head 1A described above, the pressure chamber 41 may be omitted, and the nozzle plate 5 may communicate directly with the common ink chamber 42 as illustrated in FIG. 19.

Figure 20A:
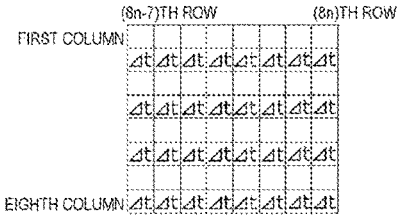
FIGS. 20A, 20B, and 20C each illustrate a matrix representing an arrangement of a nozzle to which a delay time shift Δt is added.
Figure 20B:
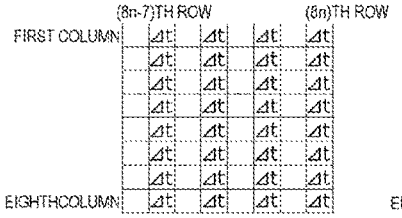
Figure 20C:
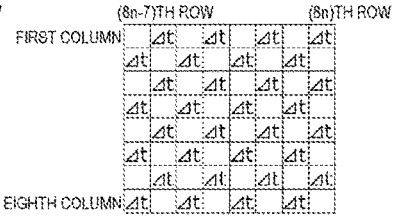

As another modification of the ink jet head 1A, a delay time shift Δt may be added to the delay time assigned to each nozzle 51. The nozzle 51 to which the delay time shift Δt is added is a part of the nozzles 51. In FIGS. 20A, 20B, and 20C, patterns of three arrangements of the nozzles 51 to which the delay time shift Δt is added are represented by the same matrix of 64 pieces (=8 columns×8 rows) as that of FIG. 11. That is, provided are three types of patterns, including: a pattern in which the delay time shift Δt is assigned for each row; a pattern in which the delay time shift Δt is assigned for each column; and a pattern in which the delay time shift Δt is assigned in a zigzag shape. In the pattern in which the delay time shift Δt is assigned for each row, for example, the delay time shift Δt is assigned every other row. In the pattern in which the delay time shift Δt is assigned for each column, for example, the delay time shift Δt is assigned every other column. In the pattern in which the delay time shift Δt is assigned in the zigzag shape, for example, the delay time shift Δt is assigned every other row and every other column. Further, the nozzle 51 to which the delay time shift Δt is added may be determined with a pattern other than the patterns of three arrangements shown in FIGS. 20A, 20B, and 20C.

The delay time shift Δt is a time which is less than a half cycle of the inherent vibration cycle λ of the ink (Δt<1 AL). As an example, a value is set within a range of −0.4 AL to 0.4 AL. The value of the delay time shift Δt may be different for each nozzle 51, but is desirably set to a common value. In this case, as can be seen from a result of the embodiment which will be described below, it is desirable to determine the value of the delay time shift Δt according to a combination of the pattern of the delay time assigned to each nozzle 51 and the pattern of the arrangement of the nozzle 51 to which the delay time shift Δt is added. Among the actuators 8 of the nozzles 51 to be driven in the same drive cycle, the drive circuit 7 serving as a drive signal supply unit supplies a drive signal to the actuator 8 of the nozzle 51 to which the delay time shift Δt is added at timing when the delay time shift Δt is added to the delay time.

Next, a simulation example performed for confirming the effect of adding the delay time shift Δt will be described. In the simulation example, a change in an ink discharge speed, at the time where the actuator 8 is driven by further adding the delay time shift Δt to the delay time set in each nozzle 51 in the sixth embodiment, the first embodiment, and fifth embodiment, is simulated.

FIG. 21 indicates a set value of a delay time and a pattern of an arrangement of the nozzle 51 to which the delay time shift Δt is added in eighteenth to twentieth embodiments. That is, the eighteenth to twentieth embodiments apply a pattern of an arrangement in which the delay time shift Δt is added for each row to the delay time of the sixth embodiment, the first embodiment, and fifth embodiment. The delay time shift Δt is variously set at an interval of 0.05 AL within the range of −0.4 AL to 0.4 AL. Further, 1 AL is about 2 μs.

Figure 22:
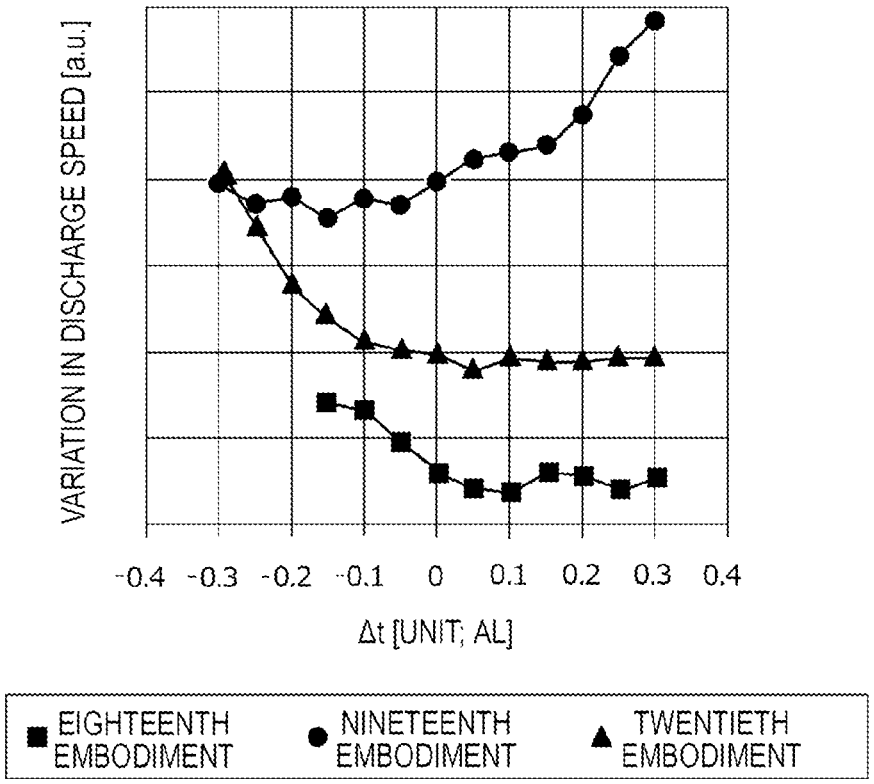
FIG. 22 is a graph illustrating a result of a variation in an ink discharge speed in the eighteenth to twentieth embodiments.

FIG. 22 is a graph illustrating a variation in a discharge speed in the eighteenth to twentieth embodiments. As can be seen from the result of FIG. 22, when the delay time shift Δt is set to +0.1 AL, the eighteenth embodiment can improve the variation by 9% more than the discharge speed of when the delay time shift Δt is not applied (Δt=0 AL), that is, the discharge speed in the sixth embodiment. When the delay time shift Δt is set to −0.15 AL, the nineteenth embodiment can improve the variation by 7% more than the discharge speed of when the delay time shift Δt is not applied (Δt=0 AL), that is, the discharge speed in the first embodiment. When the delay time shift Δt is set to +0.05 AL, the twentieth embodiment can improve the variation by 4% more than the discharge speed of when the delay time shift Δt is not applied (Δt=0 AL), that is, the discharge speed in the fifth embodiment. That is, the delay time shift Δt is added for each row to mutually shift the delay time, thereby improving the effect of reducing the crosstalk.

FIG. 23 indicates a set value of a delay time and a pattern of an arrangement of the nozzle 51 to which the delay time shift Δt is added in twenty-first to twenty-third embodiments. That is, the twenty-first to twenty-third embodiments apply a pattern of an arrangement in which the delay time shift Δt is added for each column to the delay time of the sixth embodiment, the first embodiment, and fifth embodiment. The delay time shift Δt is variously set at an interval of 0.05 AL within the range of −0.4 AL to 0.4 AL. Further, 1 AL is about 2 μs.

Figure 24:
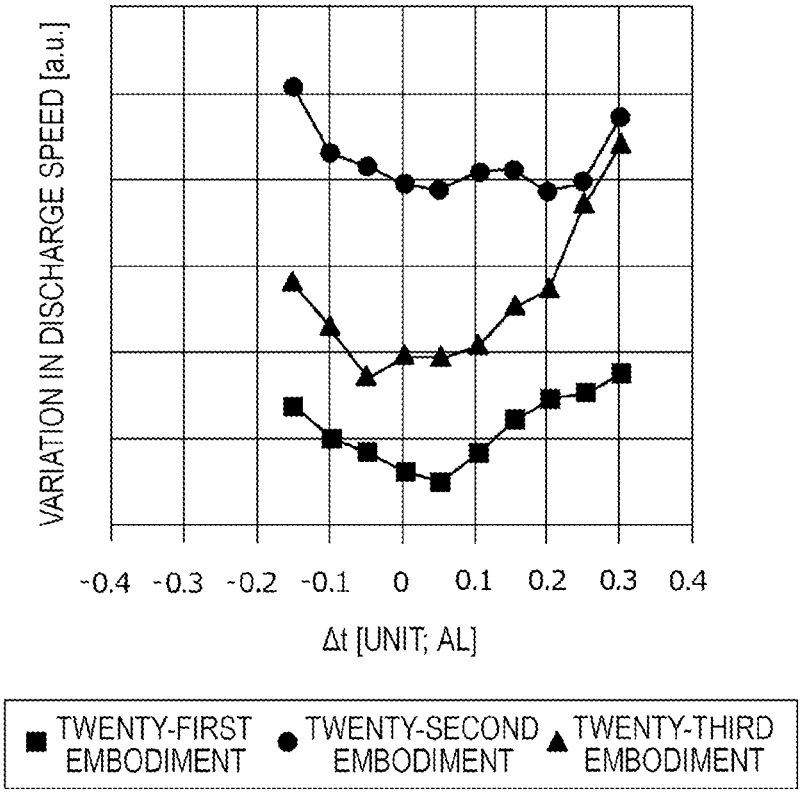
FIG. 24 is a graph illustrating a result of a variation in an ink discharge speed in the twenty-first to twenty-third embodiments.

FIG. 24 is a graph illustrating a variation in a discharge speed in the twenty-first to twenty-third embodiments. As can be seen from the result of FIG. 24, when the delay time shift Δt is set to +0.05 AL, the twenty-first embodiment can improve the variation by 4% more than the discharge speed of when the delay time shift Δt is not applied (Δt=0 AL), that is, the discharge speed in the sixth embodiment. When the delay time shift Δt is set to +0.2 AL, the twenty-second embodiment can improve the variation by 2% more than the discharge speed of when the delay time shift Δt is not applied (Δt=0 AL), that is, the discharge speed in the first embodiment. When the delay time shift Δt is set to −0.05 AL, the twenty-third embodiment can improve the variation by 6% more than the discharge speed of when the delay time shift Δt is not applied (Δt=0 AL), that is, the discharge speed in the fifth embodiment. That is, the delay time shift Δt is added for each column to mutually shift the delay time, thereby improving the effect of reducing the crosstalk.

FIG. 25 indicates a set value of a delay time and a pattern of an arrangement of the nozzle 51 to which the delay time shift Δt is added in twenty-fourth to twenty-sixth embodiments. That is, the twenty-fourth to twenty-sixth embodiments apply a pattern of an arrangement in which the delay time shift Δt is added in a zigzag shape to the delay time of the sixth embodiment, the first embodiment, and fifth embodiment. The delay time shift Δt is variously set at an interval of 0.05 AL within the range of −0.4 AL to 0.4 AL. Further, 1 AL is about 2 μs.

Figure 26:
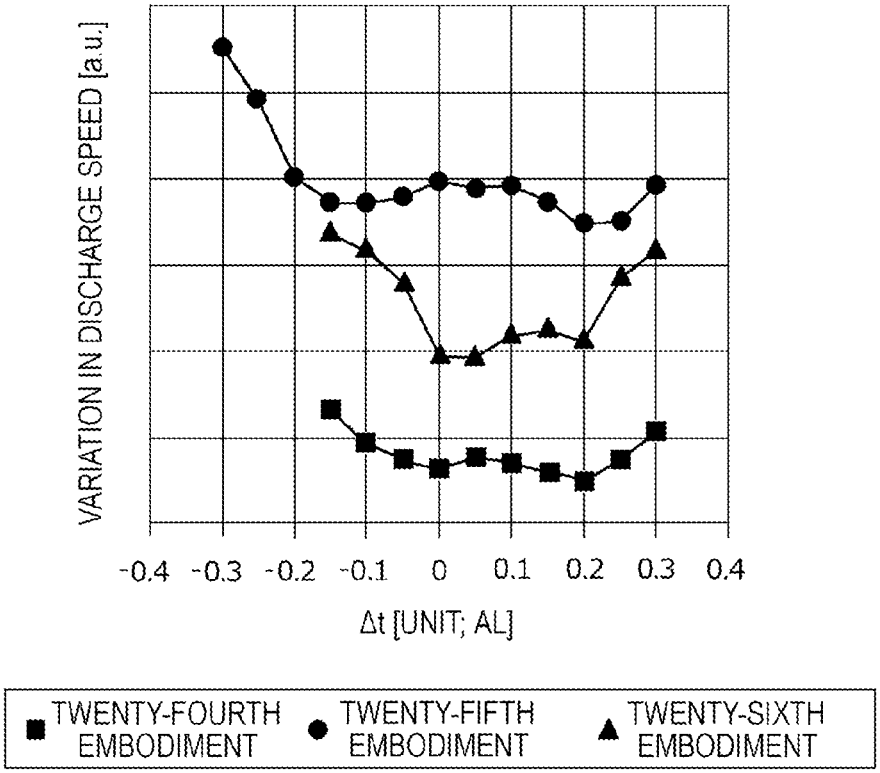
FIG. 26 is a graph illustrating a result of a variation in an ink discharge speed in the twenty-fourth to twenty-sixth embodiments.

FIG. 26 is a graph illustrating a variation in a discharge speed in the twenty-fourth to twenty-sixth embodiments. As can be seen from the result of FIG. 26, when the delay time shift Δt is set to +0.2 AL, the twenty-fourth embodiment can improve the variation by 5% more than the discharge speed of when the delay time shift Δt is not applied (Δt=0 AL), that is, the discharge speed in the sixth embodiment. When the delay time shift Δt is set to +0.2 AL, the twenty-fifth embodiment can improve the variation by 9% more than the discharge speed of when the delay time shift Δt is not applied (Δt=0 AL), that is, the discharge speed in the first embodiment. When the delay time shift Δt is set to +0.05 AL, the twenty-sixth embodiment can improve the variation by 1% more than the discharge speed of when the delay time shift Δt is not applied (Δt=0 AL), that is, the discharge speed in the fifth embodiment. That is, the delay time shift Δt is added in the zigzag shape to mutually shift the delay time, thereby improving the effect of reducing the crosstalk.

In the ink jet head 1A, both the actuator 8 and the nozzle 51 may not be disposed on the surface of the nozzle plate 5. For example, an ink jet head including an actuator of either one of, for example, a drop-on-demand piezo system, a shear wall type, and a shear mode type may be used.

Further, in the above-described embodiments, the ink jet head 1A of the ink jet printer 10 is described as an example of the liquid discharge apparatus, but the liquid discharge apparatus may be a molding material discharge head of a 3D printer and a sample discharge head of a dispensing apparatus.

While certain embodiments have been described, these embodiments have been presented by way of example only, and are not intended to limit the scope of the present disclosure. Indeed, the novel embodiments described herein may be embodied in a variety of other forms; furthermore, various omissions, substitutions and changes in the form of the embodiments described herein may be made without departing from the spirit of the present disclosure. The accompanying claims and their equivalents are intended to cover such forms or modifications as would fall within the scope and spirit of the present disclosure.

What is claimed is:

1. A liquid discharge apparatus, comprising:

a nozzle plate including an array of nozzles arranged in a first direction and a second direction and a plurality of actuators corresponding to the nozzles, the array of nozzles including first, second, and third nozzles, the first and second nozzles being directly adjacent to each other in the first direction, and the first and third nozzles being directly adjacent to each other in the second direction, and the plurality of actuators including first, second, and third actuators corresponding to the first, second, and third nozzles, respectively; and a drive controller configured to apply a drive signal to the first, second, and third actuators during a drive cycle, wherein when an inherent vibration cycle of the liquid discharge apparatus is referenced as AL, a difference between a first timing at which the drive signal is applied to the first actuator and a second timing at which the drive signal is applied to the second actuator is within a range of 0.6 AL to 1.5 AL, and a difference between the first timing and a third timing at which the drive signal is applied to the third actuator is within a range of 0.6 AL to 1.5 AL.

2. The liquid discharge apparatus according to claim 1, wherein the difference between the first timing and the second timing is equal to the difference between the first timing and the third timing.

3. The liquid discharge apparatus according to claim 1, wherein the second timing is equal to the third timing.

4. The liquid discharge apparatus according to claim 1, wherein the array of nozzles further includes a fourth nozzle, the first, second, and fourth nozzles being arranged in the first direction in this order, the plurality of actuators further includes a fourth actuator corresponding to the fourth nozzle, the drive controller is further configured to apply the drive signal to the fourth actuator during the drive cycle, and a difference between the second timing and a fourth timing at which the drive signal is applied to the fourth actuator is within a range of 0.6 AL to 1.5 AL.

5. The liquid discharge apparatus according to claim 4, wherein the difference between the first timing and the second timing is equal to the difference between the second timing and the fourth timing.

6. The liquid discharge apparatus according to claim 5, wherein the second timing is after the first timing, and the fourth timing is after the second timing.

7. The liquid discharge apparatus according to claim 1, wherein the array of nozzles further includes a fourth nozzle, the second and fourth nozzles being directly adjacent to each other in the second direction, and the third and fourth nozzles being directly adjacent to each other in the first direction, the plurality of actuators further includes a fourth actuator corresponding to the fourth nozzle, the drive controller is further configured to apply the drive signal to the fourth actuator during the drive cycle, a difference between the second timing and a fourth timing at which the drive signal is applied to the fourth actuator is within a range of 0.6 AL to 1.5 AL, and a difference between the third timing and the fourth timing is within a range of 0.6 AL to 1.5 AL.

8. The liquid discharge apparatus according to claim 7, wherein the difference between the second timing and the fourth timing is equal to the difference between the third timing and the fourth timing.

9. The liquid discharge apparatus according to claim 8, wherein the fourth timing is after the second timing and the third timing.

10. An image forming apparatus, comprising:

a sheet conveyer; and an inkjet head configured to discharge ink to a sheet conveyed by the sheet conveyer, the inkjet head including a liquid discharge apparatus according to claim 1.

* * * * *